US008676066B2

(12) United States Patent
Funatsu

(10) Patent No.: US 8,676,066 B2
(45) Date of Patent: Mar. 18, 2014

(54) IMAGE FORMING APPARATUS HAVING CONTROL UNIT

(75) Inventor: Kenichi Funatsu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 176 days.

(21) Appl. No.: 13/278,520

(22) Filed: Oct. 21, 2011

(65) Prior Publication Data

US 2012/0099877 A1 Apr. 26, 2012

(30) Foreign Application Priority Data

Oct. 22, 2010 (JP) ..... 2010-237364

(51) Int. Cl.
*G03G 15/00* (2006.01)
*G03G 21/00* (2006.01)

(52) U.S. Cl.
USPC ..... 399/26; 399/12; 399/13; 399/27; 399/81

(58) Field of Classification Search
USPC ..... 399/13, 12, 26, 24, 27, 81
See application file for complete search history.

(56) References Cited

U.S. PATENT DOCUMENTS

2003/0133719 A1* 7/2003 Tsuruya et al. ..... 399/12
2006/0045546 A1* 3/2006 Okochi ..... 399/13
2009/0295071 A1* 12/2009 Takahashi et al. ..... 271/162

FOREIGN PATENT DOCUMENTS

JP 07-281563 A 10/1995
JP 08-305225 A 11/1996

* cited by examiner

*Primary Examiner* — Sophia S Chen
(74) *Attorney, Agent, or Firm* — Kubotera & Associates, LLC

(57) ABSTRACT

An image forming apparatus includes a consumable supply detachably attached to an apparatus main body; a detection unit for detecting that the consumable supply is exchanged; a display unit for displaying the consumable supply detected with the detection unit; and an input unit for receiving an input operation for confirming whether the consumable supply detected with the detection unit is correctly exchanged.

8 Claims, 18 Drawing Sheets

Please replace photosensitive drum.

| C | M | Y | K |
|---|---|---|---|
| × | ○ | ○ | ○ |

FIG. 5

Photosensitive drum: Exchange the drum shown below?

| C | M | Y | K |
|---|---|---|---|
| – | ☆ | – | – |

OK Cancel

FIG. 8

Please exchange the correct photosensitive drum.

| C | M | Y | K |
|---|---|---|---|
| × | – | – | – |

FIG. 9

Photosensitive drum: Photosensitive drum shown below is exchanged before its expiration. Is photosensitive drum exchanged correctly?

| C | M | Y | K |
|---|---|---|---|
| – | ☆ | – | – |

OK Cancel

FIG. 13

PHOTOSENSITIVE DRUM
Please replace photosensitive drum indicated below.

| C | M | Y | K |
|---|---|---|---|
| × | – | – | – |

OK

FIG. 17

IMAGE FORMING APPARATUS HAVING CONTROL UNIT

BACKGROUND OF THE INVENTION AND RELATED ART STATEMENT

The present invention relates to an image forming apparatus using a consumable supply such as a photosensitive drum, toner, and the like.

In a conventional image forming apparatus, when a photosensitive drum as a consumable supply is exchanged, a fuse attached to the photosensitive drum is checked. When the fuse is not broken, it is considered that the photosensitive drum is a brand new one and not used yet. Accordingly, an accumulation print number counter is initialized, and the fuse is broken. After the time on, a print number is counted, so that a life of the photosensitive drum is measured.

Further, another conventional image forming apparatus is provided with a sensor for detecting whether a photosensitive drum is exchanged (refer to Patent Reference).

Patent Reference: Japanese Patent Publication No. 08-305225

In some cases, the conventional image forming apparatus may have four photosensitive drums for developing images in four colors as the consumable supplies. In this case, when one of the photosensitive drums is exchanged after the life thereof is expired, and an operator mistakenly exchanges another of the photosensitive drums whose life is not expired yet with a new photosensitive drum, the fuse of the new photosensitive drum is inevitably broken. Further, the accumulation print number counter of the conventional image forming apparatus is initialized.

Accordingly, even though the operator notices later that the photosensitive drum whose life is not expired yet is mistakenly exchanged with the new photosensitive drum, and the operator switches the new photosensitive drum back to the previously installed photosensitive drum, it is not possible to count an exact accumulation print number since the accumulation print number counter has been already initialized. Accordingly, it is difficult to accurately measure the life of the photosensitive drum.

Further, after the new photosensitive drum is switched back to the previously installed photosensitive drum, when the new photosensitive drum is installed in the conventional image forming apparatus one more time, the fuse of the new photosensitive drum is already broken. Accordingly, the accumulation print number counter is not initialized this time. As a result, it is not possible to count an exact accumulation print number of the new photosensitive drum. Further, even though the new photosensitive drum is installed, a message is displayed on a display unit to prompt the user to exchange the photosensitive drum.

In view of the problems described above, an object of the present invention is to provide an image forming apparatus capable of solving the problems of the conventional image forming apparatus, and preventing a new consumable supply from being exchanged even when a life thereof is not expired.

Further objects and advantages of the invention will be apparent from the following description of the invention.

SUMMARY OF THE INVENTION

In order to attain the objects described above, according to the present invention, an image forming apparatus includes a consumable supply detachably attached to an apparatus main body; a detection unit for detecting that the consumable supply is exchanged; a display unit for displaying the consumable supply detected with the detection unit; and an input unit for receiving an input operation for confirming whether the consumable supply detected with the detection unit is correctly exchanged.

In the present invention, it is possible to prevent a new consumable supply from being exchanged even when a life thereof is not expired and the consumable supply is still usable.

BRIEF DESCRIPTION OF THE DRAWINGS

FIG. 5 is a schematic view No. 1 showing an alarm screen of the image forming apparatus according to the first embodiment of the present invention;

FIG. 8 is a schematic view showing a confirmation screen of the image forming apparatus according to the first embodiment of the present invention;

FIG. 9 is a schematic view No. 2 showing the alarm screen of the image forming apparatus according to the first embodiment of the present invention;

FIG. 13 is a schematic view showing a confirmation screen of the image forming apparatus according to the second embodiment of the present invention;

FIG. 17 is a schematic view showing an alarm screen of the image forming apparatus according to the third embodiment of the present invention;

DETAILED DESCRIPTION OF THE PREFERRED EMBODIMENTS

Hereunder, embodiments of the present invention will be explained with reference to the accompanying drawings

First Embodiment

Figure 2:
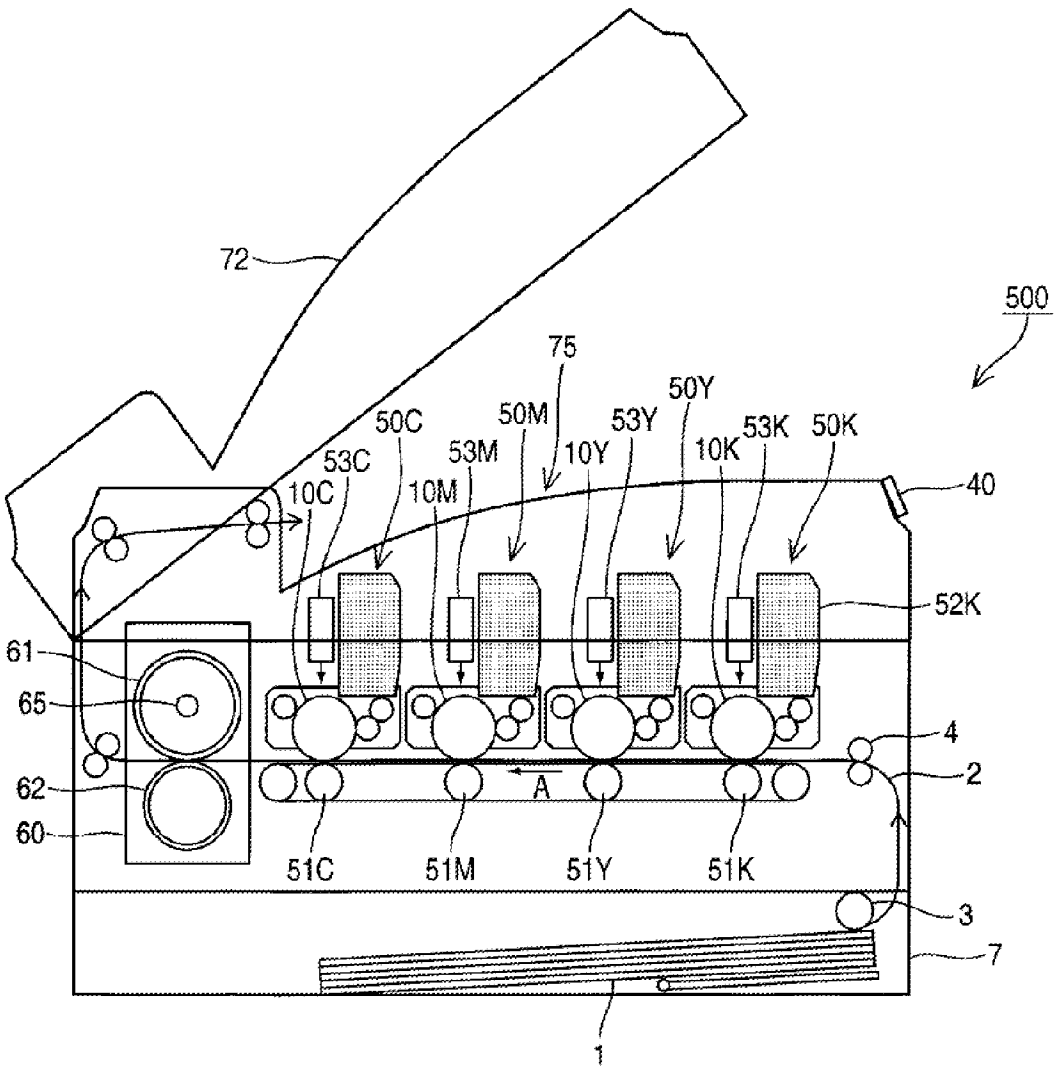
FIG. 2 is a schematic sectional side view showing the image forming apparatus according to the first embodiment of the present invention.

A first embodiment of the present invention will be explained. FIG. 2 is a schematic sectional side view showing a printer 500 as an image forming apparatus according to the first embodiment of the present invention.

As shown in FIG. 2, the printer 500 includes a medium drawing member 3; image forming units 50K, 50Y, 50M, and 50C; transfer units 51K, 51Y, 51M, and 51C; and a thermal fixing device 60 along a medium transportation path 2 for transporting a printing medium 1 in an arrow direction A.

In the embodiment, the image forming units 50K, 50Y, 50M, and 50C are provided for forming images using toner (for example, 52K of black) in four colors (black or K, yellow or Y, magenta or M, cyan or C) on photosensitive drums 10K, 10Y, 10M, and 10C with exposure units 53K, 53Y, 53M, and 53C.

In the embodiment, the photosensitive drums 10K, 10Y, 10M, and 10C are detachably attached to a main body of the printer 500 as consumable supplies, so that a user can replace. Resetting members 11K, 11Y, 11M, and 11C (refer to FIG. 1) are disposed in the photosensitive drums 10K, 10Y, 10M, and 10C, respectively.

In the embodiment, the printer 500 further includes counters 12K, 12Y, 12M, and 12C corresponding to the photosensitive drums 10K, 10Y, 10M, and 10C in a non-volatile memory (not shown) such as an EEPROM (electrically erasable and programmable read only memory). The counters 12K, 12Y, 12M, and 12C are provided as a measurement unit for measuring a consumed amount of the consumable supply.

In the embodiment, the resetting members 11K, 11Y, 11M, and 11C are provided as a detection unit for detecting whether the photosensitive drums 10K, 10Y, 10M, and 10C are replaced, and are formed of fuses. The resetting members 11K, 11Y, 11M, and 11C are not broken when the photosensitive drums 10K, 10Y, 10M, and 10C are new. The resetting members 11K, 11Y, 11M, and 11C are broken when the photosensitive drums 10K, 10Y, 10M, and 10C are in use.

Accordingly, it is detected whether the resetting members 11K, 11Y, 11M, and 11C are changed from a non-broken state to a broken state, so that it is possible to detect whether the photosensitive drums 10K, 10Y, 10M, and 10C with the resetting members 11K, 11Y, 11M, and 11C in the broken state are replaced. Further, the resetting members 11K, 11Y, 11M, and 11C also function as a usage recording unit for recording whether the photosensitive drums 10K, 10Y, 10M, and 10C as the consumable supplies are used.

In the embodiment, when one of the photosensitive drums 10K, 10Y, 10M, and 10C is attached to the printer 500, and the user performs a specific operation, one of the resetting members 11K, 11Y, 11M, and 11C corresponding to the one of the photosensitive drums 10K, 10Y, 10M, and 10C is broken. Further, a value of one of the counters 12K, 12Y, 12M, and 12C corresponding to the one of the photosensitive drums 10K, 10Y, 10M, and 10C is initialized.

In the embodiment, a tray 7 is disposed at one end portion of the medium transportation path 2 for storing the printing medium 1. A stacker 75 is disposed at the other end portion of the medium transportation path 2 for placing the printing medium 1 after the printing medium 1 is printed with the image forming units 50K, 50Y, 50M, and 50C and discharged.

In the embodiment, the medium drawing member 3 is provided for picking up the printing medium 1 one by one. After the medium drawing member 3 picks up the printing medium 1, a transportation roller (not shown) transports the printing medium 1. After a register roller 4 positions the printing medium 1, the transfer units 51K, 51Y, 51M, and 51C transfer toner images attached to the photosensitive drums 10K, 10Y, 10M, and 10C to the printing medium 1 at image forming portions as contact points between the medium transportation path 2 and the photosensitive drums 10K, 10Y, 10M, and 10C.

In the embodiment, the thermal fixing device 60 includes a fixing roller 61 and a pressing roller 62, and the fixing roller 61 has a heat source 65. After the toner images are transferred to the printing medium 1 with the image forming units 50K, 50Y, 50M, and 50C and the transfer units 51K, 51Y, 51M, and 51C, the printing medium 1 is transported to the thermal fixing device 60, so that a thermal fixing process is performed on the printing medium 1 at a contact point between the fixing roller 61 and the pressing roller 62. After the thermal fixing process is performed on the printing medium 1, the printing medium 1 is transported to the stacker 75 with the transportation roller and discharged.

In the embodiment, a front cover switch 40 is disposed on a housing near the image forming units 50K, 50Y, 50M, and 50C. When the user opens a front cover 72 to replace the consumable supply such as the toner 52K or the photosensitive drums 10K, 10Y, 10M, and 10C, the front cover switch 40 detects that the front cover 72 is opened.

Figure 1:
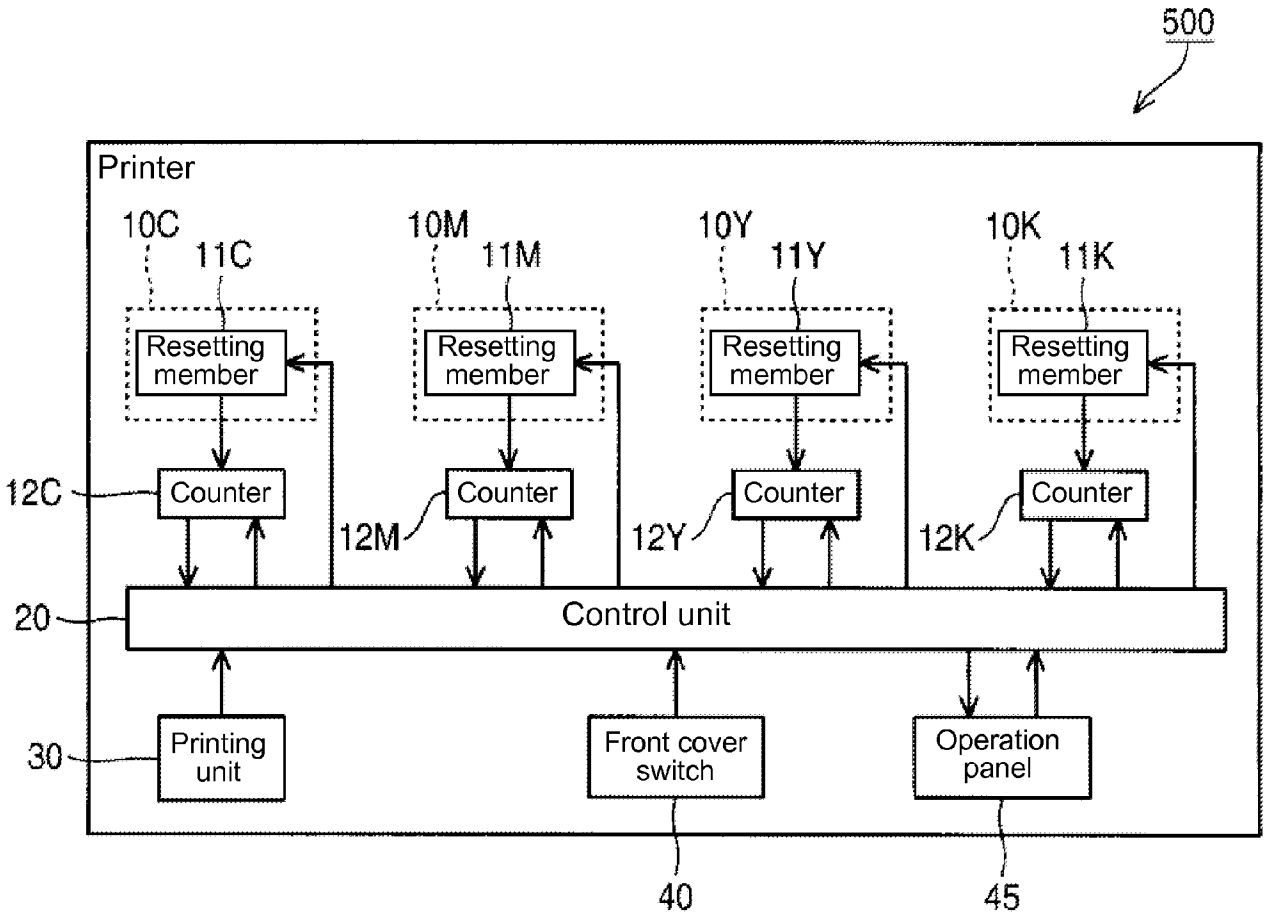
FIG. 1 is a block diagram showing a configuration of an image forming apparatus according to a first embodiment of the present invention.

FIG. 1 is a block diagram showing a configuration of the image forming apparatus or the printer 500 according to the first embodiment of the present invention. As shown in FIG. 1, in addition to the photosensitive drums 10K, 10Y, 10M, and 10C disposed in the image forming units 50K, 50Y, 50M, and 50C, the printer 500 includes a control unit 20, a printing unit 30, the front cover switch 40, and an operation panel 45. The printer 500 forms and outputs a color image according to print job data received from an upper device or a copy original.

As described above, the photosensitive drums 10K, 10Y, 10M, and 10C as the consumable supplies include the resetting members 11K, 11Y, 11M, and 11C. Further, the counters 12K, 12Y, 12M, and 12C are disposed corresponding to the photosensitive drums 10K, 10Y, 10M, and 10C, respectively.

In the embodiment, the resetting members 11K, 11Y, 11M, and 11C are disposed in the storage unit of the printer 500 for counting an accumulation print number of the photosensitive drums 10K, 10Y, 10M, and 10C as the consumed amount thereof. Further, the printing unit 30 counts a print number of the printing medium 1, and the control unit 20 accumulates the print number, so that a life of the photosensitive drums 10K, 10Y, 10M, and 10C is calculated.

In the embodiment, the control unit 20 as a control section includes a CPU (central processing unit) as a central processing calculation unit and a memory as a storage unit including the non-volatile memory as described above. The control unit 20 is provided for controlling an entire operation of the printer 500 according to a control program (software) stored in the storage unit.

In the embodiment, according to an instruction from the control unit 20, the printing unit 30 transports the printing medium 1 and forms the images using toner on the photosensitive drums 10K, 10Y, 10M, and 10C, so that the images are transferred to the printing medium 1. Afterward, the thermal fixing device 60 shown in FIG. 1 performs the thermal fixing process on the printing medium 1, and the printing medium 1 is discharged.

Further, the printing unit 30 counts the number of the printing medium 1 thus discharged, and notifies the number to the control unit 20.

In the embodiment, the control unit 20 accumulates the number of the printing medium 1 notified from the printing unit 30 in the counters 12K, 12Y, 12M, and 12C, thereby calculating the accumulation print numbers of the photosensitive drums 10K, 10Y, 10M, and 10C. Further, the control unit 20 is configured to receive an input indicating a conductive state of the resetting members 11K, 11Y, 11M, and 11C, so that the control unit 20 detects whether each of the resetting members 11K, 11Y, 11M, and 11C is broken.

Further, the control unit 20 is configured to output a signal to the resetting members 11K, 11Y, 11M, and 11C, so that a specific one of the resetting members 11K, 11Y, 11M, and 11C is broken. In the embodiment, when one of the photosensitive drums 10K, 10Y, 10M, and 10C with the resetting member that is not broken is attached to the printer 500, and the one of the photosensitive drums 10K, 10Y, 10M, and 10C starts being used, the control unit 20 sends the signal to the corresponding one of the resetting members 11K, 11Y, 11M, and 11C to be broken. Further, the control unit 20 initializes the value of the corresponding one of the counters 12K, 12Y, 12M, and 12C to zero.

As shown in FIG. 2, the front cover switch 40 is disposed on the housing of the printer 500 near the image forming units 50K, 50Y, 50M, and 50C. When the user opens the front cover 72 to replace the consumable supply such as the toner or the photosensitive drums 10K, 10Y, 10M, and 10C, the front cover switch 40 detects that the front cover 72 is opened and notifies the control unit 20.

In the embodiment, the operation panel 45 is provided as a display unit or an input unit. More specifically, the operation panel 45 functions as the display unit for displaying contents, so that the control unit 20 of the printer 500 notifies the contents to the user. Further, the operation panel 45 functions as the input unit for receiving an input operation of the user through an operation button, and notifies contents of the input operation thus received to the control unit 20.

Figure 3:
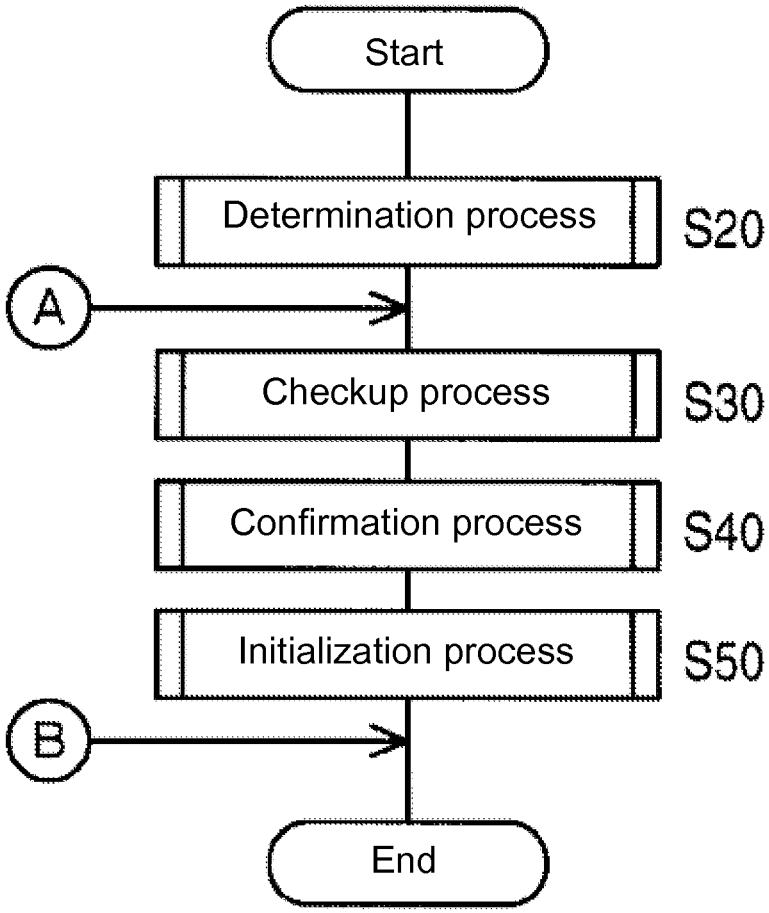
FIG. 3 is a flow chart showing an operation of the image forming apparatus in a drum exchange process according to the first embodiment of the present invention.

An operation of the printer 500 will be explained with reference to FIGS. 1 to 3. FIG. 3 is a flow chart showing the operation of the image forming apparatus or the printer 500 in a drum exchange process according to the first embodiment of the present invention.

As described above, in the printer 500, every time when the printing medium 1 is printed and discharged, the printing unit 30 counts the number of the printing medium 1 thus discharged, and notifies the number to the control unit 20. Further, the control unit 20 accumulates the number of the printing medium 1 notified from the printing unit 30 in the counters 12K, 12Y, 12M, and 12C to be stored as the accumulation print numbers of the photosensitive drums 10K, 10Y, 10M, and 10C. Accordingly, it is possible to calculate the life of the toner or the photosensitive drums 10K, 10Y, 10M, and 10C. In the following description, it is supposed that the consumable supplies are the photosensitive drums 10K, 10Y, 10M, and 10C having the resetting members 11K, 11Y, 11M, and 11C (the fuses).

In step S20, every time when the printing medium 1 is printed and outputted, the control unit 20 of the printer 500 performs a determination process. More specifically, the control unit 20 retrieves the accumulation print number of each of the photosensitive drums 10K, 10Y, 10M, and 10C from each of the counters 12K, 12Y, 12M, and 12C. When the accumulation print number exceeds a specific print number indicating that one of the photosensitive drums 10K, 10Y, 10M, and 10C expires the life thereof, the control unit 20 displays a screen through the operation panel 45 for prompting the user to replace the one of the photosensitive drums 10K, 10Y, 10M, and 10C whose life is expired. Regardless of the determination process, when the front cover 72 is opened or closed, the front cover switch 40 is turned on or off to be notified to the control unit 20.

In step S30, when the control unit 20 receives an off (open) signal from the front cover switch 40, the control unit 20 starts a checkup process. Accordingly, the control unit 20 prompts the user through the operation panel 45 to close the front cover 72. Further, when the control unit 20 detects that the front cover 72 is closed, the control unit 20 checks up all of the resetting members 11K, 11Y, 11M, and 11C. When the control unit 20 detects a brand new one of the photosensitive drums 10K, 10Y, 10M, and 10C with non-broken one of the resetting members 11K, 11Y, 11M, and 11C, the process proceeds to step S40.

In step S40, the control unit 20 starts a confirmation process. More specifically, the control unit 20 prompts the user through the operation panel 45 to confirm whether the brand new one of the photosensitive drums 10K, 10Y, 10M, and 10C detected in the checkup process is to be exchanged (whether a wrong one of the photosensitive drums 10K, 10Y, 10M, and 10C is mistakenly installed). When the brand new one of the photosensitive drums 10K, 10Y, 10M, and 10C is correctly installed, the process proceeds to step S50. When the wrong one of the photosensitive drums 10K, 10Y, 10M, and 10C is mistakenly installed, the control unit 20 waits until the user installs the right one of the photosensitive drums 10K, 10Y, 10M, and 10C.

In step S50, the control unit 20 starts an initialization process. More specifically, the control unit 20 breaks the corresponding one of the resetting members 11K, 11Y, 11M, and 11C of the brand new one of the photosensitive drums 10K, 10Y, 10M, and 10C. Further, the control unit 20 initializes the value of the corresponding one of the counters 12K, 12Y, 12M, and 12C of the brand new one of the photosensitive drums 10K, 10Y, 10M, and 10C, thereby completing the process.

Figure 4:
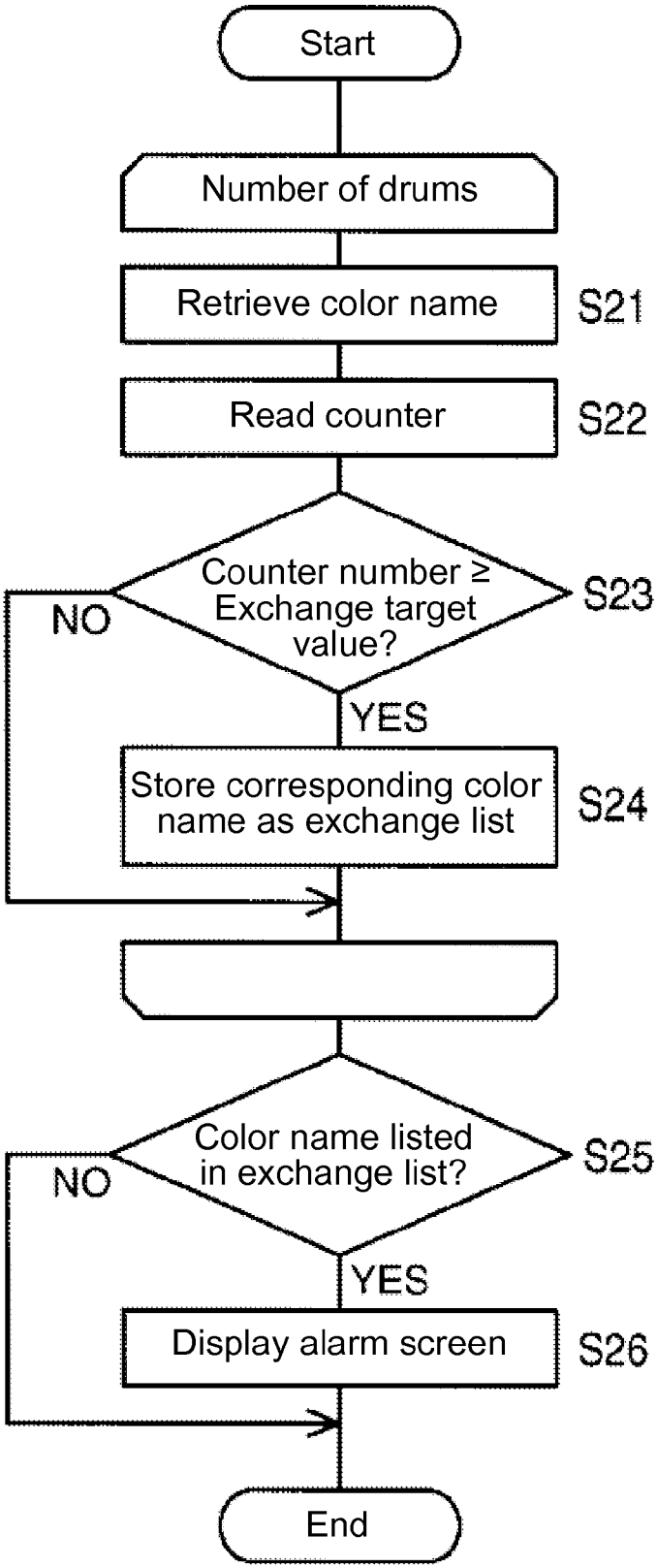
FIG. 4 is a flow chart showing the operation of the image forming apparatus in a determination process according to the first embodiment of the present invention.

The determination process of the control unit 20 shown in FIG. 3 (S20) will be explained with reference to FIGS. 1, 2, and 4. FIG. 4 is a flow chart showing the operation of the image forming apparatus or the printer 500 in the determination process according to the first embodiment of the present invention.

In step S21, every time when the printing medium 1 is printed and outputted, the control unit 20 retrieves a color name of each of the photosensitive drums 10K, 10Y, 10M, and 10C (for example, black or K, yellow or Y, magenta or M, cyan or C).

In step S22, every time when the printing medium 1 is printed and outputted, the control unit 20 reads each of the counters 12K, 12Y, 12M, and 12C of the photosensitive drums 10K, 10Y, 10M, and 10C, thereby obtaining the counter value (the accumulation print number) as the consumed amount of the consumable supply.

In step S23, the control unit 20 compares the counter number with an exchange target value as a threshold value stored in the storage unit in advance to determine whether the count value exceeds the exchange target value or the life is expired. When the control unit 20 determines that the counter number exceeds the exchange target value indicating that the life is expired, the process proceeds to step S24. When the control unit 20 determines that the counter number does not exceed the exchange target value indicating that the life is not expired, the process returns to step S21.

In step S24, when the control unit 20 determines that the counter number exceeds the exchange target value indicating that the life is expired, the control unit 20 stores the color name of the corresponding one of the photosensitive drums 10K, 10Y, 10M, and 10C as an exchange list in the storage unit. It is noted that the exchange list is stored only temporarily, and is initialized every time when the determination process is started. The process from step S21 to step S24 is repeated with respect to the photosensitive drums 10K, 10Y, 10M, and 10C in all colors.

In step S25, the control unit 20 determines whether the color name of one of the photosensitive drums 10K, 10Y, 10M, and 10C whose life is expired is listed (stored) in the exchange list. When the control unit 20 determines that the color name is listed in the exchange list, the process proceeds to step S26. When the control unit 20 determines that the color name is not listed in the exchange list, the process is complete.

In step S26, when the control unit 20 determines that the color name is listed in the exchange list, the control unit 20 displays the alarm screen on the operation panel 45 for prompting the user to replace the one of the photosensitive drums 10K, 10Y, 10M, and 10C whose life is expired, thereby completing the process.

FIG. 5 is a schematic view No. 1 showing the alarm screen of the image forming apparatus or the printer 500 according to the first embodiment of the present invention. As shown in FIG. 5, in this case, the alarm screen indicates that the life of the photosensitive drum 10C in cyan is expired.

Figure 6:
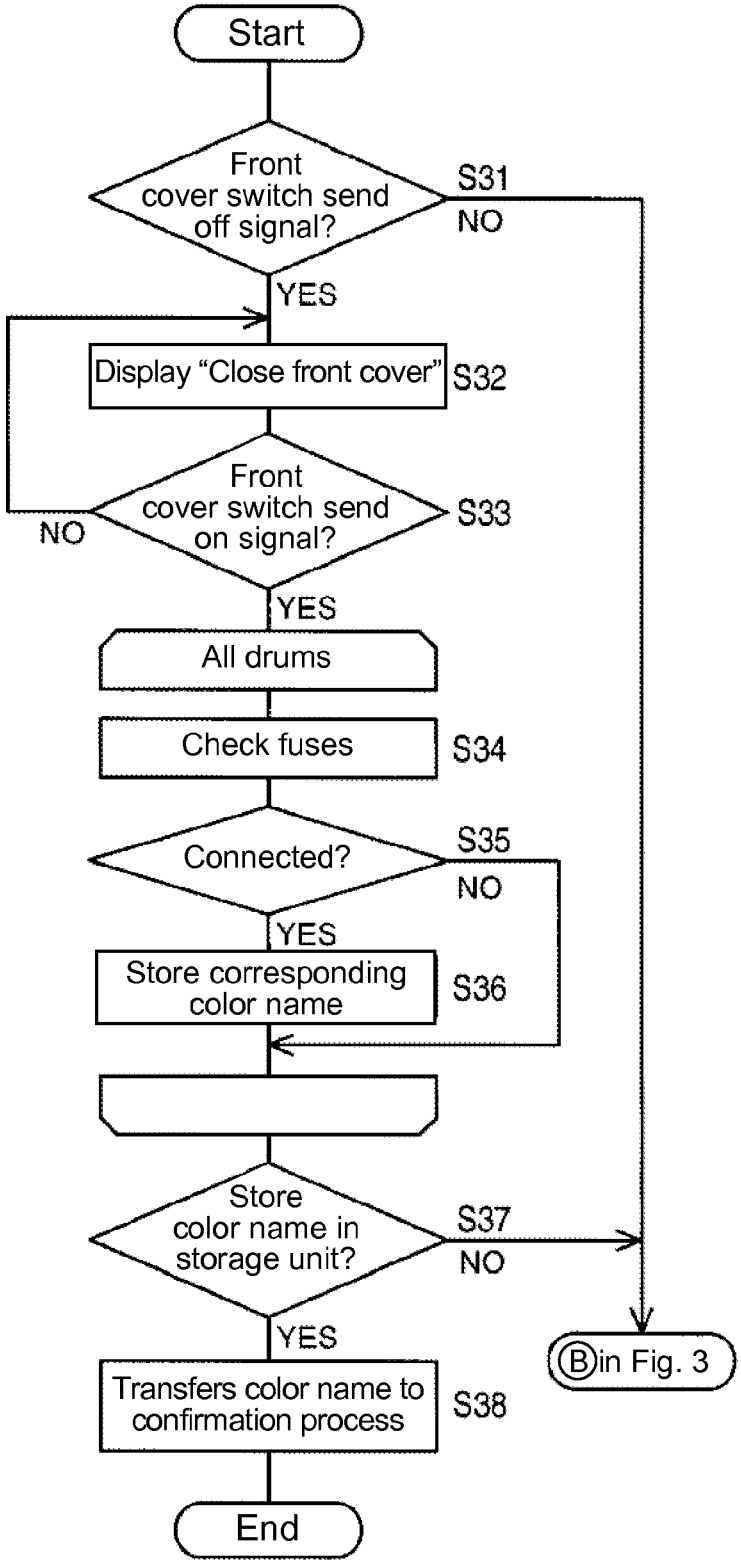
FIG. 6 is a flow chart showing the operation of the image forming apparatus in a checkout process according to the first embodiment of the present invention.

The checkup process of the control unit 20 shown in FIG. 3 (S30) will be explained with reference to FIGS. 1, 2, and 6. FIG. 6 is a flow chart showing the operation of the image forming apparatus or the printer 500 in the checkout process according to the first embodiment of the present invention. It is supposed that after one of the photosensitive drums 10K, 10Y, 10M, and 10C whose life is expired is detected, when the user confirms the alarm screen for prompting to replace the one of the photosensitive drums 10K, 10Y, 10M, and 10C, the user opens the front cover 72 to replace the one of the photosensitive drums 10K, 10Y, 10M, and 10C.

In step S31, every time when the front cover 72 is opened or closed, the front cover switch 40 sends the off signal (opened) or the on signal (closed) to the control unit 20, and the control unit 20 determines whether the front cover switch 40 sends the off signal or the on signal. When the control unit 20 receives the off signal of the front cover switch 40, the process proceeds to step S32. When the control unit 20 receives the on signal of the front cover switch 40, the photosensitive drums 10K, 10Y, 10M, and 10C are not replaced. Accordingly, the process is complete, and returns to the printing process.

In step S32, when the control unit 20 receives the off signal of the front cover switch 40, the control unit 20 displays a screen representing "Close front cover" on the operation panel 45 to prompt the user to close the front cover 72, and the control unit 20 waits until the front cover 72 is closed. In step S33, the control unit 20 determines whether the front cover switch 40 sends the off signal or the on signal.

In step S34, when the front cover 72 is closed and the control unit 20 receives the on signal from the front cover switch 40, the control unit 20 checks all of the resetting members 11K, 11Y, 11M, and 11C or the fuses. In step S35, the control unit 20 determines whether the resetting members 11K, 11Y, 11M, and 11C or the fuses are not broken, indicating the photosensitive drums 10K, 10Y, 10M, and 10C are brand new. When the control unit 20 determines that one of the resetting members 11K, 11Y, 11M, and 11C or the fuses is not broken (connected), the process proceeds to step S36. When the control unit 20 determines that all of the resetting members 11K, 11Y, 11M, and 11C or the fuses are broken, the process returns to step S34.

In step S36, when the control unit 20 determines that one of the resetting members 11K, 11Y, 11M, and 11C or the fuses is not broken, the control unit 20 determines that the corresponding one of the photosensitive drums 10K, 10Y, 10M, and 10C with the unbroken fuse is brand new and just installed, and temporarily stores the color name of the corresponding one of the photosensitive drums 10K, 10Y, 10M, and 10C in the storage unit. The process from step S34 to step S36 is repeated with respect to the photosensitive drums 10K, 10Y, 10M, and 10C in all colors.

In step S37, after the control unit 20 completely checks the fuses of all of the photosensitive drums 10K, 10Y, 10M, and 10C, the control unit 20 determines whether the color name of the corresponding one of the photosensitive drums 10K, 10Y, 10M, and 10C with the unbroken fuse is stored in the storage unit. When the control unit 20 determines that the color name is stored in the storage unit, the process proceeds to step S38. When the control unit 20 determines that the color name is not stored in the storage unit, the process is complete and returns to the printing process.

In step S38, when the control unit 20 determines that the color name of the corresponding one of the photosensitive drums 10K, 10Y, 10M, and 10C with the unbroken fuse is stored in the storage unit, the control unit 20 determines that the corresponding one of the photosensitive drums 10K, 10Y, 10M, and 10C with the unbroken fuse is brand new and just installed, and transfers the color name as a return value to the confirmation process, thereby completing the process.

Figure 7:
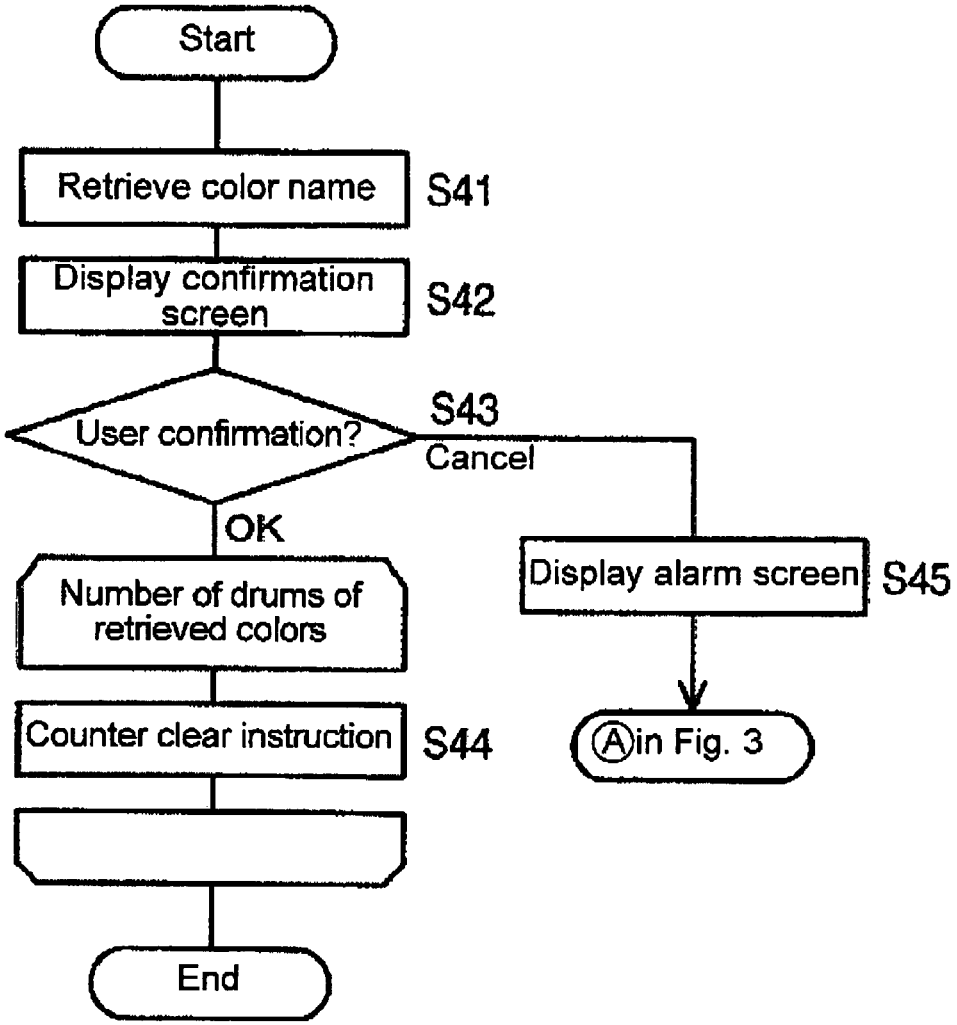
FIG. 7 is a flow chart showing the operation of the image forming apparatus in a confirmation process according to the first embodiment of the present invention.

The confirmation process of the control unit 20 shown in FIG. 3 (S40) will be explained with reference to FIGS. 1, 2, and 7. FIG. 7 is a flow chart showing the operation of the image forming apparatus in the confirmation process according to the first embodiment of the present invention.

In step S41, the control unit 20 retrieves the color name transferred from the checkup process as the color name of the brand new one of the photosensitive drums 10K, 10Y, 10M, and 10C. In step S42, the control unit 20 displays the confirmation screen on the operation panel 45 for indicating that the brand new one of the photosensitive drums 10K, 10Y, 10M, and 10C corresponding to the color name is to be exchanged.

In the embodiment, the confirmation screen displays the color name of the brand new one of the photosensitive drums 10K, 10Y, 10M, and 10C thus detected. The confirmation screen includes an operation button for confirming whether one of the photosensitive drums 10K, 10Y, 10M, and 10C is to be exchanged, or the one of the photosensitive drums 10K, 10Y, 10M, and 10C is the photosensitive drum to be exchanged.

FIG. 8 is a schematic view showing the confirmation screen of the image forming apparatus or the printer 500 according to the first embodiment of the present invention. For example, when the control unit 20 retrieves magenta (M) as the color name in step S41, the confirmation screen shown in FIG. 8 is displayed on the operation panel 45.

As shown in FIG. 8, the confirmation screen includes a text indicating that the photosensitive drum 10M is to be exchanged with the new one; an "OK" button for confirming that the photosensitive drum 10M is correctly exchanged; and a "Cancel" button for confirming that the photosensitive drum 10M is not correctly exchanged. In this case, it may be configured such that the alarm screen shown in FIG. 5 is concurrently displayed.

In step S43, the user confirms the confirmation screen displayed on the operation panel 45, and determines whether the photosensitive drum is correctly exchanged. When the exchanged one of the photosensitive drums 10K, 10Y, 10M, and 10C is the one of the photosensitive drums 10K, 10Y, 10M, and 10C in the color displayed on the confirmation screen, the user pushes the OK button displayed on the confirmation screen. When the exchanged one of the photosensitive drums 10K, 10Y, 10M, and 10C is not the one of the photosensitive drums 10K, 10Y, 10M, and 10C in the color displayed on the confirmation screen, the user pushes the Cancel button displayed on the confirmation screen. When the user pushes the OK button, the process proceeds to step S44. When the user pushes the Cancel button, the process proceeds to step S45.

In step S44, when the control unit 20 determines that the user pushes the OK button, the control unit 20 stores a counter clear instruction in the storage unit for initializing a corresponding one of the counters 12K, 12Y, 12M, and 12C corresponding to the one of the photosensitive drums 10K, 10Y, 10M, and 10C in the color name retrieved in step S41, thereby completing the process.

In step S45, when the control unit 20 determines that the user pushes the Cancel button in step S43, the control unit 20 displays the alarm screen shown in FIG. 9 on the operation panel 45. The alarm screen prompts the user to exchange the correct one of the photosensitive drums 10K, 10Y, 10M, and 10C in the right color according to the exchange list stored in the storage unit, so that the user exchanges the correct one of the photosensitive drums 10K, 10Y, 10M, and 10C whose life is expired. FIG. 9 is a schematic view No. 2 showing the alarm screen of the image forming apparatus or the printer 500 according to the first embodiment of the present invention. Afterward, the process proceeds to the checkup process shown in FIG. 3.

Figure 10:
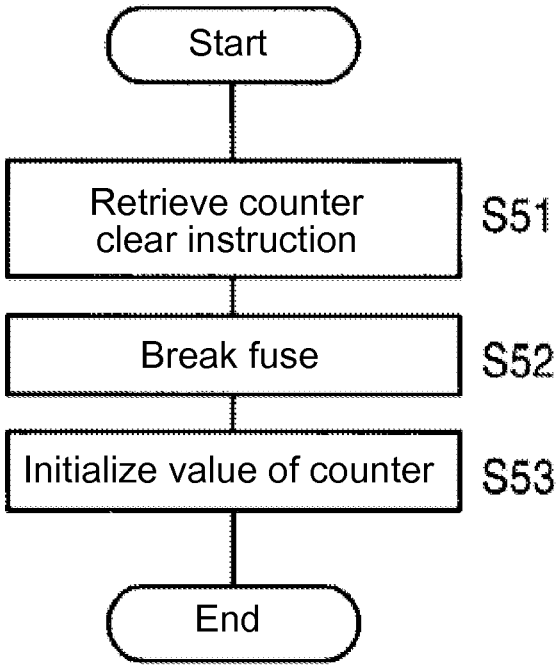
FIG. 10 is a flow chart showing the operation of the image forming apparatus in an initialization process according to the first embodiment of the present invention.

The initialization process of the control unit 20 shown in FIG. 3 (S50) will be explained with reference to FIGS. 1, 2, and 10. FIG. 10 is a flow chart showing the operation of the image forming apparatus or the printer 500 in the initialization process according to the first embodiment of the present invention.

In step S51, the control unit 20 retrieves the counter clear instruction stored in the storage unit. In step S52, after the control unit 20 retrieves the counter clear instruction, the control unit 20 breaks one of the resetting members 11K, 11Y, 11M, and 11C (the fuses) corresponding to the specified one of the photosensitive drums 10K, 10Y, 10M, and 10C. In step S53, after the control unit 20 breaks one of the resetting members 11K, 11Y, 11M, and 11C (the fuses), the control unit 20 initializes the value of one of the counters 12K, 12Y, 12M, and 12C corresponding to the specified one of the photosensitive drums 10K, 10Y, 10M, and 10C to zero, thereby completing the process.

As described above, in the embodiment, when the user exchanges the photosensitive drum with the brand new one, the counter corresponding to the photosensitive drum is reset after the user confirms that the photosensitive drum thus exchanged is the correct one. Accordingly, it is possible to prevent the counter of the photosensitive drum that is not necessary to be exchanged from being reset due to a wrong exchange of the photosensitive drum by the user. Further, it is possible to correctly initialize the counter corresponding to the photosensitive drum that is exchanged, thereby making it possible to effectively monitor the life of the consumable supply.

As described above, in the embodiment, the counter of the photosensitive drum thus exchanged is initialized according to the confirmation process of the user. Accordingly, it is possible to prevent the counter of the photosensitive drum that is not necessary to be exchanged from being initialized due to the wrong exchange of the photosensitive drum by the user. As a result, it is possible to effectively monitor the life of the consumable supply.

Second Embodiment

A second embodiment of the present invention will be explained. Components in the second embodiment similar to those in the first embodiment are designated with the same reference numerals, and explanations thereof are omitted.

Figure 11:
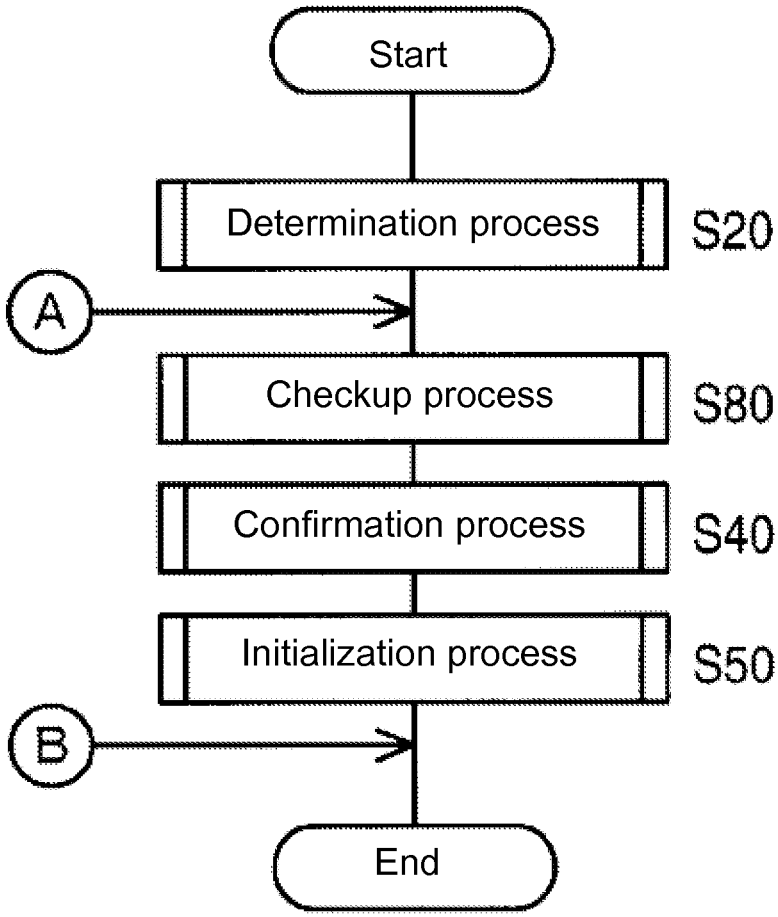
FIG. 11 is a flow chart showing an operation of an image forming apparatus in a drum exchange process according to a second embodiment of the present invention.

An operation of an image forming apparatus in the second embodiment will be explained with reference to FIG. 11. FIG. 11 is a flow chart showing the operation of the image forming apparatus or the printer 500 in a drum exchange process according to the second embodiment of the present invention.

As described above, in the printer 500, every time when the printing medium 1 is printed and discharged, the printing unit 30 counts the number of the printing medium 1 thus discharged, and notifies the number to the control unit 20. Further, the control unit 20 accumulates the number of the printing medium 1 notified from the printing unit 30 in the counters 12K, 12Y, 12M, and 12C to be stored as the accumulation print numbers of the photosensitive drums 10K, 10Y, 10M, and 10C. Accordingly, it is possible to calculate the life of the toner 52 or the photosensitive drums 10K, 10Y, 10M, and 10C. In the following description, it is supposed that the consumable supplies are the photosensitive drums 10K, 10Y, 10M, and 10C having the resetting members 11K, 11Y, 11M, and 11C (the fuses).

In step S20, every time when the printing medium 1 is printed and outputted, the control unit 20 of the printer 500 performs the determination process. More specifically, the control unit 20 retrieves the accumulation print number of each of the photosensitive drums 10K, 10Y, 10M, and 10C from each of the counters 12K, 12Y, 12M, and 12C. When the accumulation print number exceeds the specific print number indicating that one of the photosensitive drums 10K, 10Y, 10M, and 10C expires the life thereof, the control unit 20 displays the screen through the operation panel 45 for prompting the user to replace the one of the photosensitive drums 10K, 10Y, 10M, and 10C whose life is expired. Regardless of the determination process, when the front cover 72 is opened or closed, the front cover switch 40 is turned on or off to be notified to the control unit 20.

In step S80, when the control unit 20 receives the off (open) signal from the front cover switch 40, the control unit 20 starts the checkup process. Accordingly, the control unit 20 prompts the user through the operation panel 45 to close the front cover 72. Further, when the control unit 20 detects that the front cover 72 is closed, the control unit 20 checks up all of the resetting members 11K, 11Y, 11M, and 11C. When the control unit 20 detects a brand new one of the photosensitive drums 10K, 10Y, 10M, and 10C with non-broken one of the resetting members 11K, 11Y, 11M, and 11C, the process proceeds to step S40.

In step S40, the control unit 20 starts the confirmation process. More specifically, the control unit 20 prompts the user through the operation panel 45 to confirm whether the brand new one of the photosensitive drums 10K, 10Y, 10M, and 10C detected in the checkup process is to be exchanged (whether a wrong one of the photosensitive drums 10K, 10Y, 10M, and 10C is mistakenly installed). When the brand new one of the photosensitive drums 10K, 10Y, 10M, and 10C is correctly installed, the process proceeds to step S50. When the wrong one of the photosensitive drums 10K, 10Y, 10M, and 10C is mistakenly installed, the control unit 20 waits until the user installs the right one of the photosensitive drums 10K, 10Y, 10M, and 10C.

In step S50, the control unit 20 starts the initialization process. More specifically, the control unit 20 breaks the corresponding one of the resetting members 11K, 11Y, 11M, and 11C of the brand new one of the photosensitive drums 10K, 10Y, 10M, and 10C. Further, the control unit 20 initializes the value of the corresponding one of the counters 12K, 12Y, 12M, and 12C of the brand new one of the photosensitive drums 10K, 10Y, 10M, and 10C, thereby completing the process.

Figure 12:
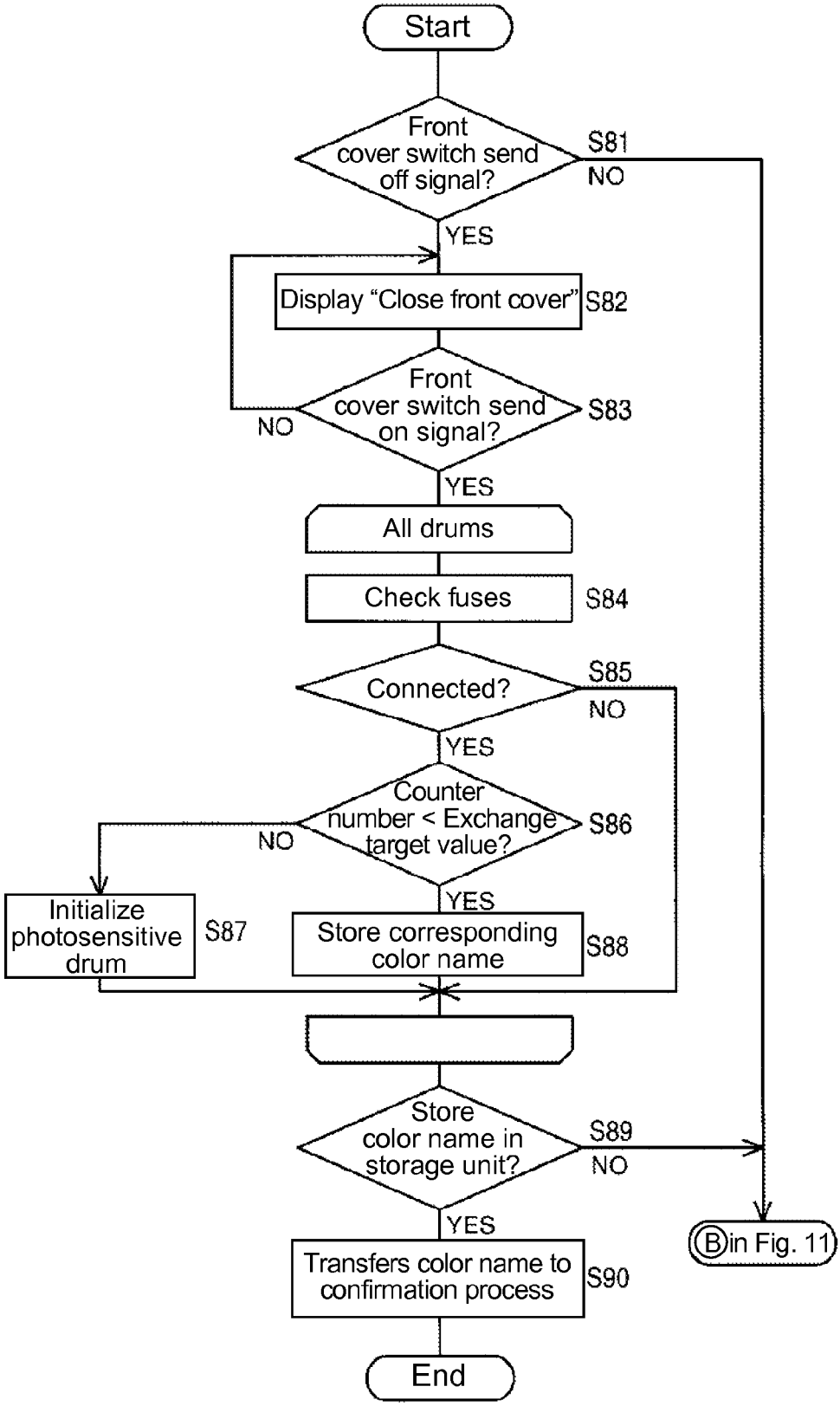
FIG. 12 is a flow chart showing the operation of the image forming apparatus in a checkout process according to the second embodiment of the present invention.

The checkup process of the control unit 20 shown in FIG. 11 (S80) will be explained with reference to FIG. 12. FIG. 12 is a flow chart showing the operation of the image forming apparatus or the printer 500 in the checkout process according to the second embodiment of the present invention.

In the second embodiment, the determination process (S20), the confirmation process (S40) and the initialization process (S50) are similar to the determination process (S20), the confirmation process (S40) and the initialization process (S50) in the first embodiment, and explanations thereof are omitted. Further, the process from step S81 to step S84 is similar to the process from step S31 to step S34 shown in FIG. 6, and explanations thereof are omitted.

In step S85, after the control unit 20 checks up the fuses, the control unit 20 determines whether the resetting members 11K, 11Y, 11M, and 11C or the fuses are not broken (connected), indicating the photosensitive drums 10K, 10Y, 10M, and 10C are brand new. When the control unit 20 determines that one of the resetting members 11K, 11Y, 11M, and 11C or the fuses is not broken, the process proceeds to step S86. When the control unit 20 determines that all of the resetting members 11K, 11Y, 11M, and 11C or the fuses are broken, the process returns to step S84.

When the control unit 20 determines that one of the resetting members 11K, 11Y, 11M, and 11C or the fuses is not broken (connected), the control unit 20 retrieves the counter value (the accumulation print number) from the corresponding one of the counters 12K, 12Y, 12M, and 12C of the one of the photosensitive drums 10K, 10Y, 10M, and 10C with the unbroken fuse.

In step S86, the control unit 20 compares the counter value with the exchange target value as the threshold value stored in the storage unit in advance to determine whether the count value exceeds the exchange target value or the life is expired. When the control unit 20 determines that the counter number does not exceed the exchange target value indicating that the life is not expired, the process returns to step S88. When the control unit 20 determines that the counter number exceeds the exchange target value indicating that the life is expired, the process proceeds to step S87.

In step S87, when the control unit 20 determines that the counter number exceeds the exchange target value indicating that the life is expired, the control unit 20 determines that the one of the photosensitive drums 10K, 10Y, 10M, and 10C is exchanged due to the expired life. Accordingly, the control unit 20 stores the counter clear instruction in the storage unit for initializing the one of the photosensitive drums 10K, 10Y, 10M, and 10C. Further, the control unit 20 breaks one of the resetting members 11K, 11Y, 11M, and 11C (the fuses) corresponding to the one of the photosensitive drums 10K, 10Y, 10M, and 10C specified in the initialization process. Further, the control unit 20 initializes the value of one of the counters 12K, 12Y, 12M, and 12C corresponding to the one of the photosensitive drums 10K, 10Y, 10M, and 10C to zero, and the process returns to step S84.

In step S88, when the control unit 20 determines that the counter number does not exceed the exchange target value indicating that the life is not expired, the control unit 20 determines that the one of the photosensitive drums 10K, 10Y, 10M, and 10C is mistakenly exchanged. Accordingly, the control unit 20 temporarily stores the color name of the one of the photosensitive drums 10K, 10Y, 10M, and 10C in the storage unit, and the process returns to step S84. The process from step S84 to step S88 is repeated with respect to the photosensitive drums 10K, 10Y, 10M, and 10C in all colors.

In step S89, after the control unit 20 completely checks the fuses of all of the photosensitive drums 10K, 10Y, 10M, and 10C, the control unit 20 determines whether the color name of the corresponding one of the photosensitive drums 10K, 10Y, 10M, and 10C with the counter value less than the exchange target value is stored in the storage unit and the unexpired life. When the control unit 20 determines that the color name is stored in the storage unit, the process proceeds to step S90. When the control unit 20 determines that the color name is not stored in the storage unit, the control unit 20 determines that the corresponding one of the photosensitive drums 10K, 10Y, 10M, and 10C is correctly exchanged due to the expired life, and the process is complete and returns to the printing process.

In step S90, when the control unit 20 determines that the color name of the corresponding one of the photosensitive drums 10K, 10Y, 10M, and 10C is stored in the storage unit, the control unit 20 determines that the corresponding one of the photosensitive drums 10K, 10Y, 10M, and 10C is incorrectly exchanged, and transfers the color name as the return value to the confirmation process, thereby completing the process.

It is noted that when the color name of the corresponding one of the photosensitive drums 10K, 10Y, 10M, and 10C incorrectly exchanged is transferred as the return value to the confirmation process, the control unit 20 displays the confirmation screen on the operation panel 45 for indicating that the corresponding one of the photosensitive drums 10K, 10Y, 10M, and 10C corresponding to the color name is exchanged before the life thereof is expired, or the corresponding one of the photosensitive drums 10K, 10Y, 10M, and 10C does not reach the exchange period as in step S42 shown in FIG. 7.

In the embodiment, the confirmation screen displays the color name of the corresponding one of the photosensitive drums 10K, 10Y, 10M, and 10C with the unexpired life that is exchanged with the brand new one. The confirmation screen includes the operation button for confirming whether one of the photosensitive drums 10K, 10Y, 10M, and 10C is to be exchanged, or the one of the photosensitive drums 10K, 10Y, 10M, and 10C is the photosensitive drum to be exchanged.

FIG. 13 is a schematic view showing the confirmation screen of the image forming apparatus or the printer 500 according to the second embodiment of the present invention. For example, when the control unit 20 retrieves magenta (M) as the color name in step S41, the confirmation screen shown in FIG. 13 is displayed on the operation panel 45. The confirmation screen includes a text indicating that the photosensitive drum 10M is exchanged with the brand new one before the life thereof is expired; the "OK" button for confirming that the photosensitive drum 10M is correctly exchanged; and the "Cancel" button for confirming that the photosensitive drum 10M is not correctly exchanged.

As described above, in the embodiment, only when the photosensitive drum with the unexpired life is exchanged and the counter thereof does not reach the specific print number, the user confirms that the photosensitive drum is correctly exchanged. Accordingly, the confirmation process of the user is limited to the case in which the photosensitive drum with the unexpired life is exchanged. As a result, it is possible to eliminate the confirmation process of the user when the photosensitive drum with the expired life is exchanged.

As described above, in the second embodiment, in addition to the effect of the first embodiment, only when the photosensitive drum with the unexpired life is exchanged, the user confirms that the photosensitive drum is correctly exchanged. Accordingly, it is possible to simplify the confirmation process of the user.

Further, it is possible for the user to confirm that the photosensitive drum is incorrectly exchanged in advance. Accordingly, even when the user exchanges the photosensitive drum with the unexpired life as the consumable supply, it is possible for the user to notice that the photosensitive drum is incorrectly exchanged before the photosensitive drum is used.

Third Embodiment

A third embodiment of the present invention will be explained next. In the third embodiment, the counters 12K, 12Y, 12M, and 12C in the first embodiment are provided with temporary storage units 13K, 13Y, 13M, and 13C. Components in the third embodiment similar to those in the first embodiment are designated with the same reference numerals, and explanations thereof are omitted.

Figure 14:
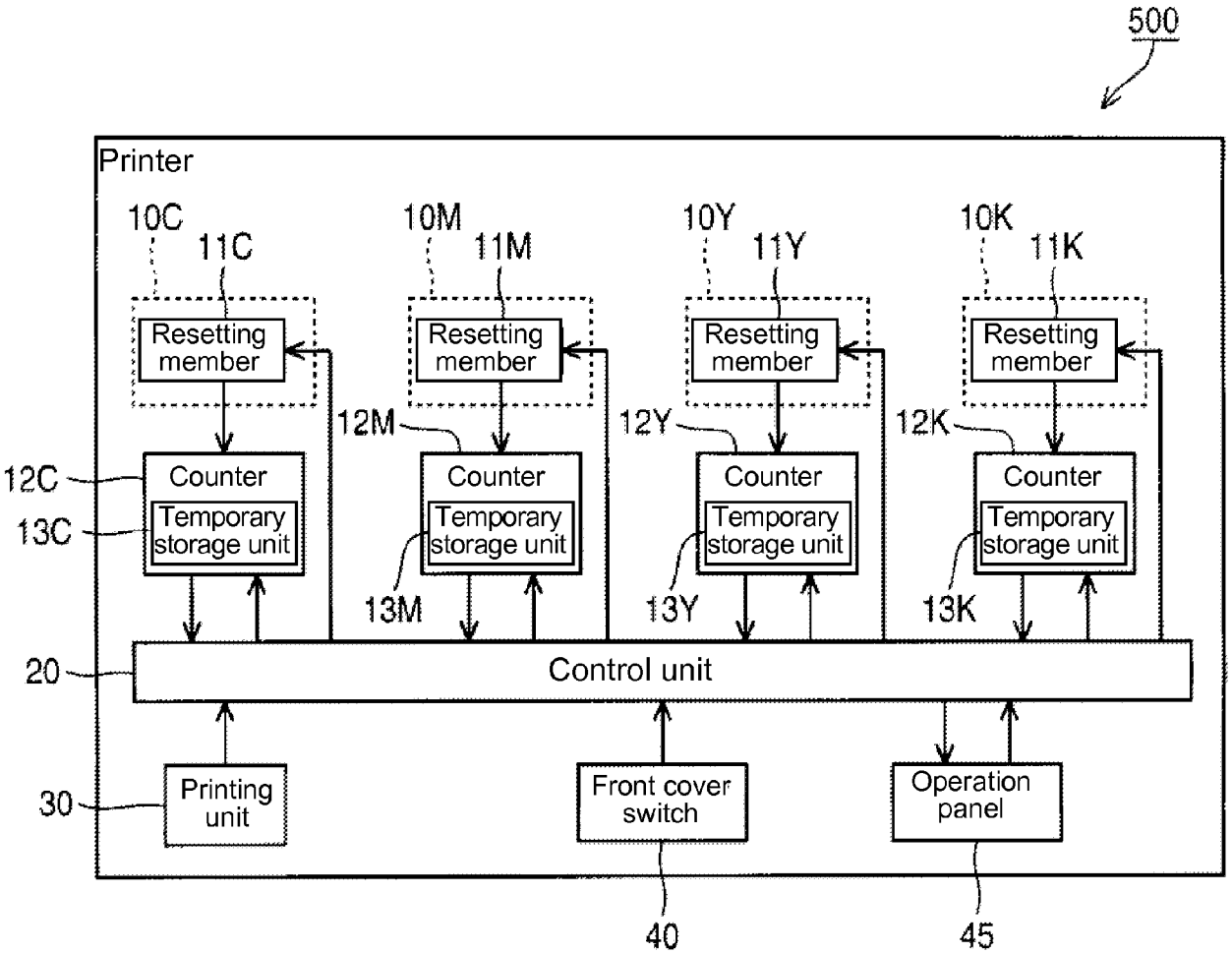
FIG. 14 is a block diagram showing a configuration of an image forming apparatus according to a third embodiment of the present invention.

A configuration of an image forming apparatus will be explained first with reference to FIG. 14. FIG. 14 is a block diagram showing the configuration of the image forming apparatus according to the third embodiment of the present invention.

As shown in FIG. 14, the printer 500 includes the temporary storage units 13K, 13Y, 13M, and 13C as a temporary storage member. The temporary storage units 13K, 13Y, 13M, and 13C are disposed as a storage area in a non-volatile memory (not shown), and correspond to the counters 12K, 12Y, 12M, and 12C.

In the embodiment, when one of the photosensitive drums 10K, 10Y, 10M, and 10C is exchanged before the life thereof is not expired, that is, the control unit 20 detects one of the photosensitive drums 10K, 10Y, 10M, and 10C with the unbroken fuse before the counter value of a corresponding one of the counters 12K, 12Y, 12M, and 12C is less than the exchange target value, the control unit 20 temporarily stores the counter values of the counters 12K, 12Y, 12M, and 12C as the consumed amount of the consumable supply in the temporary storage units 13K, 13Y, 13M, and 13C at the time of exchanging the one of the photosensitive drums 10K, 10Y, 10M, and 10C.

In the embodiment, when the control unit 20 receives the open signal or the closed signal of the front cover 72 from the front cover switch 40, the control unit 20 checks up the resetting members 11K, 11Y, 11M, and 11C (the fuses) of the photosensitive drums 10K, 10Y, 10M, and 10C to determine whether one of the photosensitive drums 10K, 10Y, 10M, and 10C is exchanged.

In the embodiment, when the control unit 20 detects one of the photosensitive drums 10K, 10Y, 10M, and 10C with non-broken one of the resetting members 11K, 11Y, 11M, and 11C (the fuses), the control unit 20 determines that the one of the photosensitive drums 10K, 10Y, 10M, and 10C is exchanged with the brand new one. Accordingly, the control unit 20 confirms the corresponding one of the counters 12K, 12Y, 12M, and 12C to determine whether the life of the one of the photosensitive drums 10K, 10Y, 10M, and 10C is expired.

In the embodiment, when the control unit 20 determine that the life of the one of the photosensitive drums 10K, 10Y, 10M, and 10C is not expired, the control unit 20 determines that the user may mistakenly exchange the one of the photosensitive drums 10K, 10Y, 10M, and 10C. Accordingly, the control unit 20 does not break the one of the resetting members 11K, 11Y, 11M, and 11C (the fuses). Further, the control unit 20 temporarily stores the counter value of the corresponding one of the counters 12K, 12Y, 12M, and 12C in the corresponding one of the temporary storage units 13K, 13Y, 13M, and 13C, and continues updating the counters 12K, 12Y, 12M, and 12C (measuring the accumulation print number).

In the embodiment, after the one of the photosensitive drums 10K, 10Y, 10M, and 10C is mistakenly exchanged before the life thereof is not expired, the user may notice that the one of the photosensitive drums 10K, 10Y, 10M, and 10C is mistakenly exchanged, and install again the previous one of the photosensitive drums 10K, 10Y, 10M, and 10C before the counter value of the corresponding one of the counters 12K, 12Y, 12M, and 12C exceeds a specific number (for example, 100 sheets) from the counter value temporarily stored in the corresponding one of the temporary storage units 13K, 13Y, 13M, and 13C, the control unit 20 detects that the previous one of the photosensitive drums 10K, 10Y, 10M, and 10C with the broken one of the resetting members 11K, 11Y, 11M, and 11C (the fuses) is installed. In this case, the control unit 20 returns the counter value stored in the corresponding one of the temporary storage units 13K, 13Y, 13M, and 13C to the one of the counters 12K, 12Y, 12M, and 12C.

On the other hand, when the control unit 20 does not detect that the previous one of the photosensitive drums 10K, 10Y, 10M, and 10C with the broken one of the resetting members 11K, 11Y, 11M, and 11C (the fuses) is installed after the specific number of the printing medium 1 is printed, the control unit 20 breaks one of the resetting members 11K, 11Y, 11M, and 11C (the fuses) of the one of the photosensitive drums 10K, 10Y, 10M, and 10C thus exchanged. Further, the control unit 20 subtracts the counter value stored in the corresponding one of the temporary storage units 13K, 13Y, 13M, and 13C from the counter value of the one of the counters 12K, 12Y, 12M, and 12C, and initializes the one of the counters 12K, 12Y, 12M, and 12C with the subtracted value. It is noted that the specific number (for example, 100 sheets) is stored in the storage unit such as the non-volatile memory in advance.

Figure 15:
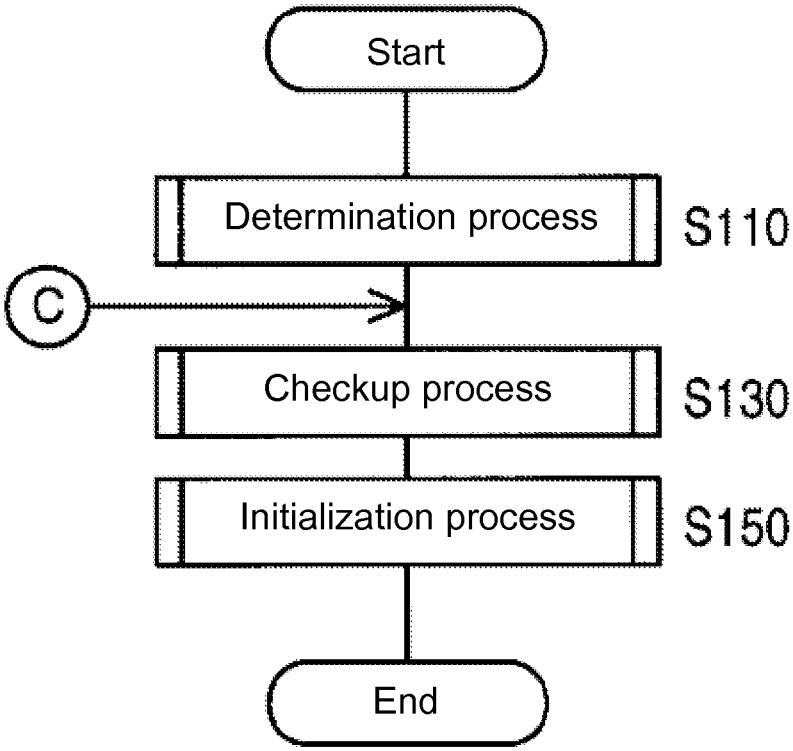
FIG. 15 is a flow chart showing an operation of the image forming apparatus in a drum exchange process according to the third embodiment of the present invention.

An operation of the printer 500 will be explained next with reference to FIGS. 14 and 15. FIG. 15 is a flow chart showing the operation of the image forming apparatus or the printer 500 in the drum exchange process according to the third embodiment of the present invention.

As described above, in the printer 500, every time when the printing medium 1 is printed and discharged, the control unit 20 obtains through the printing unit 30 the number of the printing medium 1 thus outputted per printing operation. Further, the control unit 20 accumulates the number of the printing medium 1 thus obtained in the counters 12K, 12Y, 12M, and 12C to be stored as the accumulation print numbers. Accordingly, it is possible to calculate the life of the toner or the photosensitive drums 10K, 10Y, 10M, and 10C. In the following description, it is supposed that the consumable supplies are the photosensitive drums 10K, 10Y, 10M, and 10C having the resetting members 11K, 11Y, 11M, and 11C (the fuses).

In step S110, every time when the printing medium 1 is printed and outputted, the control unit 20 of the printer 500 performs the determination process. More specifically, the control unit 20 retrieves the accumulation print number of each of the photosensitive drums 10K, 10Y, 10M, and 10C from each of the counters 12K, 12Y, 12M, and 12C. When the accumulation print number exceeds the specific print number indicating that one of the photosensitive drums 10K, 10Y, 10M, and 10C expires the life thereof, the control unit 20 displays the screen through the operation panel 45 for prompting the user to replace the one of the photosensitive drums 10K, 10Y, 10M, and 10C whose life is expired. Regardless of the determination process, when the front cover 72 is opened or closed, the front cover switch 40 is turned on or off to be notified to the control unit 20.

In step S130, when the control unit 20 receives the off (open) signal from the front cover switch 40, the control unit 20 starts the checkup process. Accordingly, the control unit 20 checks up all of the resetting members 11K, 11Y, 11M, and 11C. When the control unit 20 detects that one of the photosensitive drums 10K, 10Y, 10M, and 10C with the unexpired life is replaced with a brand new one, the control unit 20 temporarily stores the counter value of the corresponding one of the counters 12K, 12Y, 12M, and 12C before the exchange in the corresponding one of the temporary storage units 13K, 13Y, 13M, and 13C. After the exchange, the control unit 20 assumes that the user mistakenly exchange the one of the photosensitive drums 10K, 10Y, 10M, and 10C, and monitors whether the user returns the previous one of the photosensitive drums 10K, 10Y, 10M, and 10C before the exchange until the specific print number is output.

After the one of the photosensitive drums 10K, 10Y, 10M, and 10C with the unexpired life is exchanged, when the specific print number is output without returning the previous one of the photosensitive drums 10K, 10Y, 10M, and 10C before the exchange, the process proceeds to step S150. In step S150, the control unit 20 determines that the one of the photosensitive drums 10K, 10Y, 10M, and 10C is correctly exchanged, and initializes the corresponding one of the counters 12K, 12Y, 12M, and 12C.

On the other hand, after the one of the photosensitive drums 10K, 10Y, 10M, and 10C with the unexpired life is exchanged, when the one of the photosensitive drums 10K, 10Y, 10M, and 10C is replaced with the one having the broken fuse before the specific print number is output, the control unit 20 determines that the user notices that the one of the photosensitive drums 10K, 10Y, 10M, and 10C is incorrectly exchanged. Accordingly, the control unit 20 stores the counter value temporarily stored in the corresponding one of the temporary storage units 13K, 13Y, 13M, and 13C in the corresponding one of the counters 12K, 12Y, 12M, and 12C, so that the counter value corresponding to the one of the photosensitive drums 10K, 10Y, 10M, and 10C is restored.

In step S150, after the one of the photosensitive drums 10K, 10Y, 10M, and 10C with the unexpired life is exchanged, when the specific print number is output without returning the previous one of the photosensitive drums 10K, 10Y, 10M, and 10C before the exchange, the control unit 20 performs the initialization process, and breaks the corresponding one of the resetting members 11K, 11Y, 11M, and 11C of the one of the photosensitive drums 10K, 10Y, 10M, and 10C.

Further, the control unit 20 initializes the corresponding one of the counters 12K, 12Y, 12M, and 12C of the one of the photosensitive drums 10K, 10Y, 10M, and 10C with the value obtained by subtracting the counter value stored in the temporary storage units 13K, 13Y, 13M, and 13C from the counter value of the corresponding one of the counters 12K, 12Y, 12M, and 12C. Further, the control unit 20 initializes the temporary storage units 13K, 13Y, 13M, and 13C to NULL, thereby completing the process.

Figure 16:
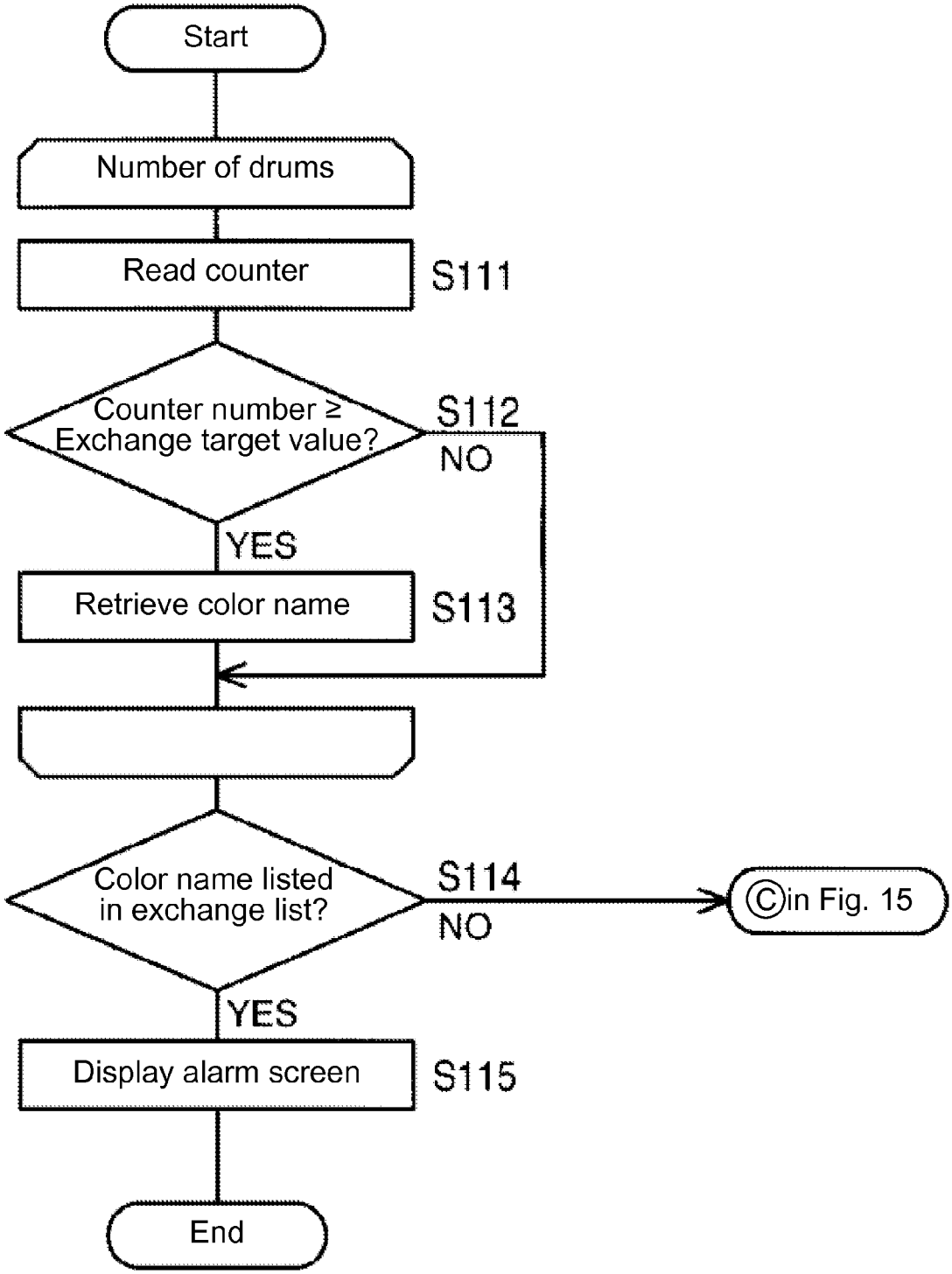
FIG. 16 is a flow chart showing the operation of the image forming apparatus in a determination process according to the third embodiment of the present invention.

The determination process of the control unit 20 shown in FIG. 15 (S110) will be explained with reference to FIG. 16. FIG. 16 is a flow chart showing the operation of the image forming apparatus or the printer 500 in the determination process according to the third embodiment of the present invention.

In step S111, every time when the printing medium 1 is printed and outputted, the control unit 20 retrieves the counters 12K, 12Y, 12M, and 12C corresponding to each of the photosensitive drums 10K, 10Y, 10M, and 10C to obtain the counter value.

In step S112, the control unit 20 compares the counter number with the exchange target value as the threshold value stored in the storage unit in advance to determine whether the count value exceeds the exchange target value or the life is expired. When the control unit 20 determines that the counter number exceeds the exchange target value indicating that the life is expired, the process proceeds to step S113. When the control unit 20 determines that the counter number does not exceed the exchange target value indicating that the life is not expired, the process returns to step S111.

In step S113, when the control unit 20 determines that the counter number exceeds the exchange target value indicating that the life is expired, the control unit 20 stores the color name of the corresponding one of the photosensitive drums 10K, 10Y, 10M, and 10C as the exchange list in the storage unit. It is noted that the exchange list is stored only temporarily, and is initialized every time when the determination process is started. The process from step S111 to step S113 is repeated with respect to the photosensitive drums 10K, 10Y, 10M, and 10C in all colors.

In step S114, the control unit 20 determines whether the color name of one of the photosensitive drums 10K, 10Y, 10M, and 10C whose life is expired is listed (stored) in the exchange list. When the control unit 20 determines that the color name is listed in the exchange list, the process proceeds to step S115. When the control unit 20 determines that the color name is not listed in the exchange list, the process is complete.

In step S115, when the control unit 20 determines that the color name is listed in the exchange list, the control unit 20 displays the alarm screen on the operation panel 45 for prompting the user to replace the one of the photosensitive drums 10K, 10Y, 10M, and 10C whose life is expired, thereby completing the process.

FIG. 17 is a schematic view showing the alarm screen of the image forming apparatus or the printer 500 according to the third embodiment of the present invention. As shown in FIG. 17, in this case, the alarm screen indicates that the life of the photosensitive drum 10C in cyan is expired.

Figure 18:
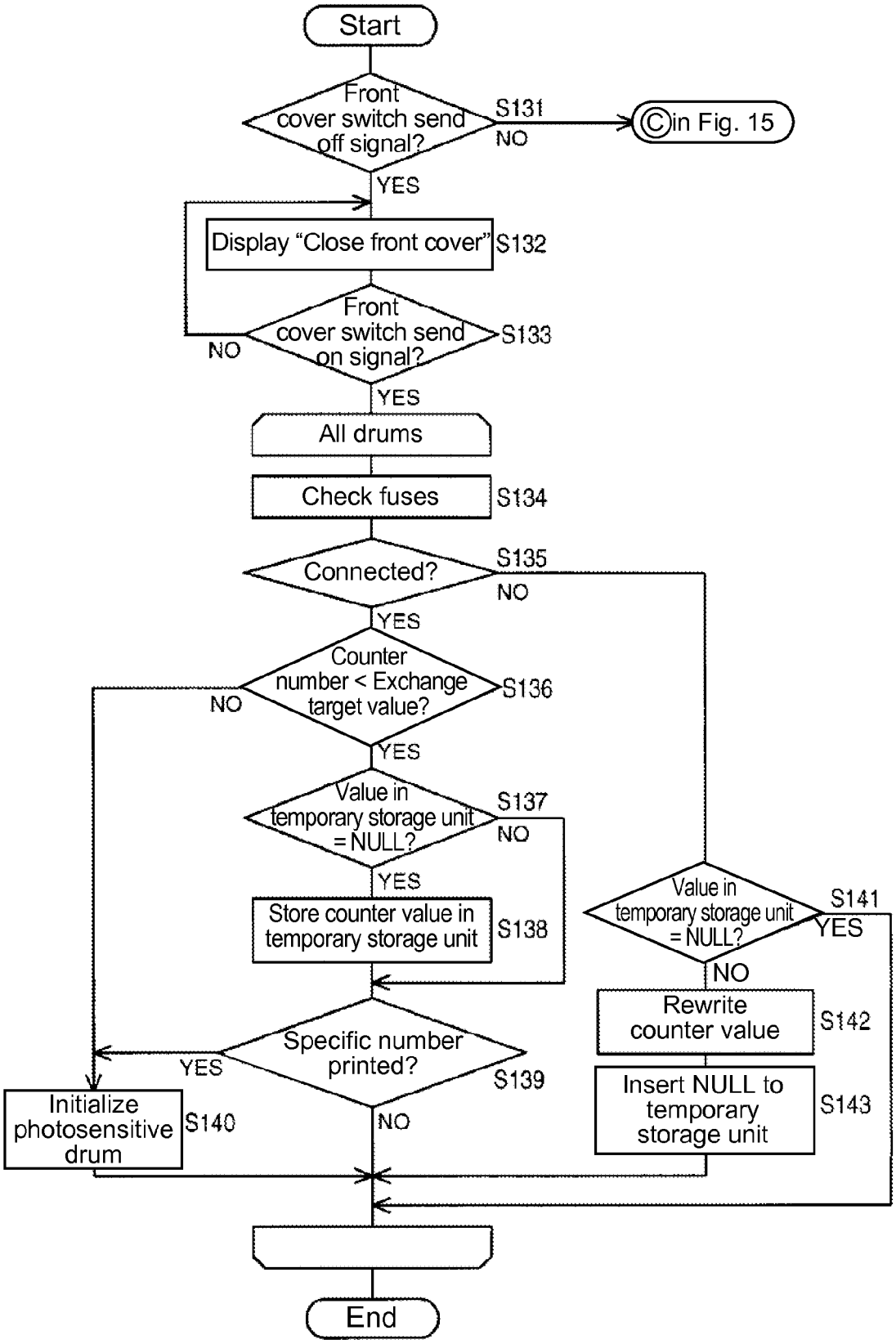
FIG. 18 is a flow chart showing the operation of the image forming apparatus in a checkout process according to the third embodiment of the present invention.

The checkup process of the control unit 20 shown in FIG. 15 (S130) will be explained with reference to FIG. 18. FIG. 18 is a flow chart showing the operation of the image forming apparatus or the printer 500 in THE checkout process according to the third embodiment of the present invention. The process from step S131 to step S134 is similar to that from step S31 to step S34 shown in FIG. 6, and an explanation thereof is omitted.

In step S135, the control unit 20 determines whether the resetting members 11K, 11Y, 11M, and 11C or the fuses are not broken (connected). When the control unit 20 determines that one of the resetting members 11K, 11Y, 11M, and 11C or the fuses is not broken (connected), the process proceeds to step S136. When the control unit 20 determines that all of the resetting members 11K, 11Y, 11M, and 11C or the fuses are broken, the process proceeds to step S141.

When the control unit 20 determines that one of the resetting members 11K, 11Y, 11M, and 11C or the fuses is not broken (connected), the control unit 20 retrieves the counter value (the accumulation print number) from the corresponding one of the counters 12K, 12Y, 12M, and 12C of the one of the photosensitive drums 10K, 10Y, 10M, and 10C with the unbroken fuse.

In step S136, the control unit 20 compares the counter value with the exchange target value as the threshold value stored in the storage unit in advance to determine whether the count value exceeds the exchange target value or the life is expired. When the control unit 20 determines that the counter number does not exceed the exchange target value indicating that the life is not expired, the process returns to step S137. When the control unit 20 determines that the counter number exceeds the exchange target value indicating that the life is expired, the process proceeds to step S140.

In step S137, when the control unit 20 determines that the counter number does not exceed the exchange target value indicating that the life is not expired, the control unit 20 retrieves the value stored in the one of the temporary storage unit 13K, 13Y, 13M, and 13C corresponding to the one of the photosensitive drums 10K, 10Y, 10M, and 10C. Then, the control unit 20 determines whether the value is NULL, or the counter value of the corresponding one of the counters 12K, 12Y, 12M, and 12C is already returned to the one of the temporary storage unit 13K, 13Y, 13M, and 13C. When the control unit 20 determines that the counter value of the corresponding one of the counters 12K, 12Y, 12M, and 12C is not returned, the process proceeds to step S138. When the control unit 20 determines that the counter value of the corresponding one of the counters 12K, 12Y, 12M, and 12C is already returned, the process proceeds to step S139.

In step S138, when the control unit 20 determines that the counter value of the corresponding one of the counters 12K, 12Y, 12M, and 12C is not returned to the one of the temporary storage unit 13K, 13Y, 13M, and 13C, the control unit 20 stores the counter value of the corresponding one of the counters 12K, 12Y, 12M, and 12C corresponding to the one of the photosensitive drums 10K, 10Y, 10M, and 10C in the one of the temporary storage unit 13K, 13Y, 13M, and 13C corresponding to the one of the photosensitive drums 10K, 10Y, 10M, and 10C.

In step S139, in every printing operation, the control unit 20 subtracts the counter value returned in the one of the temporary storage unit 13K, 13Y, 13M, and 13C corresponding to the one of the photosensitive drums 10K, 10Y, 10M, and 10C from the counter value of the corresponding one of the counters 12K, 12Y, 12M, and 12C corresponding to the one of the photosensitive drums 10K, 10Y, 10M, and 10C whose life is not expired. Then, the control unit 20 determines whether a difference exceeds the specific number, or the specific number of the printing medium 1 is printed after the one of the photosensitive drums 10K, 10Y, 10M, and 10C is exchanged.

When the control unit 20 determines that the specific number of the printing medium 1 is printed after the one of the photosensitive drums 10K, 10Y, 10M, and 10C is exchanged, the process proceeds to step S140. When the control unit 20 determines that the specific number of the printing medium 1 is not printed after the one of the photosensitive drums 10K, 10Y, 10M, and 10C is exchanged, the process returns to step S134.

As explained above, until the specific number of the printing medium 1 is printed after the one of the photosensitive drums 10K, 10Y, 10M, and 10C is exchanged, the control unit 20 stores that the one of the photosensitive drums 10K, 10Y, 10M, and 10C is used through breaking the corresponding one of the resetting members 11K, 11Y, 11M, and 11C (the fuses). Further, the control unit 20 puts on hold the initialization process, in which the corresponding one of the counters 12K, 12Y, 12M, and 12C corresponding to the one of the photosensitive drums 10K, 10Y, 10M, and 10C is initialized.

In step S140, the control unit 20 determines that the one of the photosensitive drums 10K, 10Y, 10M, and 10C is correctly exchanged. Accordingly, the control unit 20 stores the counter clear instruction in the storage unit for initializing the one of the photosensitive drums 10K, 10Y, 10M, and 10C, and the process returns to step S134.

In step S141, when the control unit 20 determines that all of the resetting members 11K, 11Y, 11M, and 11C or the fuses are broken (disconnected) in step S135, the control unit 20 retrieves the value stored in the one of the temporary storage unit 13K, 13Y, 13M, and 13C corresponding to the one of the photosensitive drums 10K, 10Y, 10M, and 10C, and determines whether the value is NULL, that is, the counter value of the corresponding one of the counters 12K, 12Y, 12M, and 12C is returned to the one of the temporary storage unit 13K, 13Y, 13M, and 13C. When the control unit 20 determines that the counter value is returned, the process proceeds to step S142. When the control unit 20 determines that the counter value is not returned, the control unit 20 determines that the one of the photosensitive drums 10K, 10Y, 10M, and 10C is normally used, and the process returns to step S134.

In step S142, when the control unit 20 determines that the counter value of the corresponding one of the counters 12K, 12Y, 12M, and 12C is returned to the one of the temporary storage unit 13K, 13Y, 13M, and 13C, the control unit 20 determines that the one of the photosensitive drums 10K, 10Y, 10M, and 10C with the unexpired life is exchanged with the brand new one. Further, the control unit 20 determines that the one of the photosensitive drums 10K, 10Y, 10M, and 10C with the broken fuse is installed, that is, the exchanged photosensitive drum is returned to the previous photosensitive drum, in place of the one of the photosensitive drums 10K, 10Y, 10M, and 10C with the unexpired life whose initialization process is put on hold.

Accordingly, the control unit 20 stores the counter value stored in the one of the temporary storage unit 13K, 13Y, 13M, and 13C corresponding to the one of the photosensitive drums 10K, 10Y, 10M, and 10C in the corresponding one of the counters 12K, 12Y, 12M, and 12C corresponding to the one of the photosensitive drums 10K, 10Y, 10M, and 10C. Accordingly, the counter value is rewritten as the counter value of the one of the photosensitive drums 10K, 10Y, 10M, and 10C before the exchange.

As described above, in the embodiment, the counter value of the corresponding one of the counters 12K, 12Y, 12M, and 12C is rewritten to the counter value stored in the one of the temporary storage unit 13K, 13Y, 13M, and 13C. Accordingly, the counter value is restored at the exchange of the one of the photosensitive drums 10K, 10Y, 10M, and 10C that is still usable. Accordingly, when the one of the photosensitive drums 10K, 10Y, 10M, and 10C continues to be used, it is possible to continue accurately counting the accumulation print number as the consumed amount of the consumable supply.

In step S143, the control unit 20 inserts NULL to the one of the temporary storage unit 13K, 13Y, 13M, and 13C corresponding to the one of the photosensitive drums 10K, 10Y, 10M, and 10C, and the process returns to step S134. The process from step S134 to step S143 is repeated with respect to the photosensitive drums 10K, 10Y, 10M, and 10C in all colors. After the control unit 20 checks the fuses of the photosensitive drums 10K, 10Y, 10M, and 10C in all colors, the process is complete.

Figure 19:
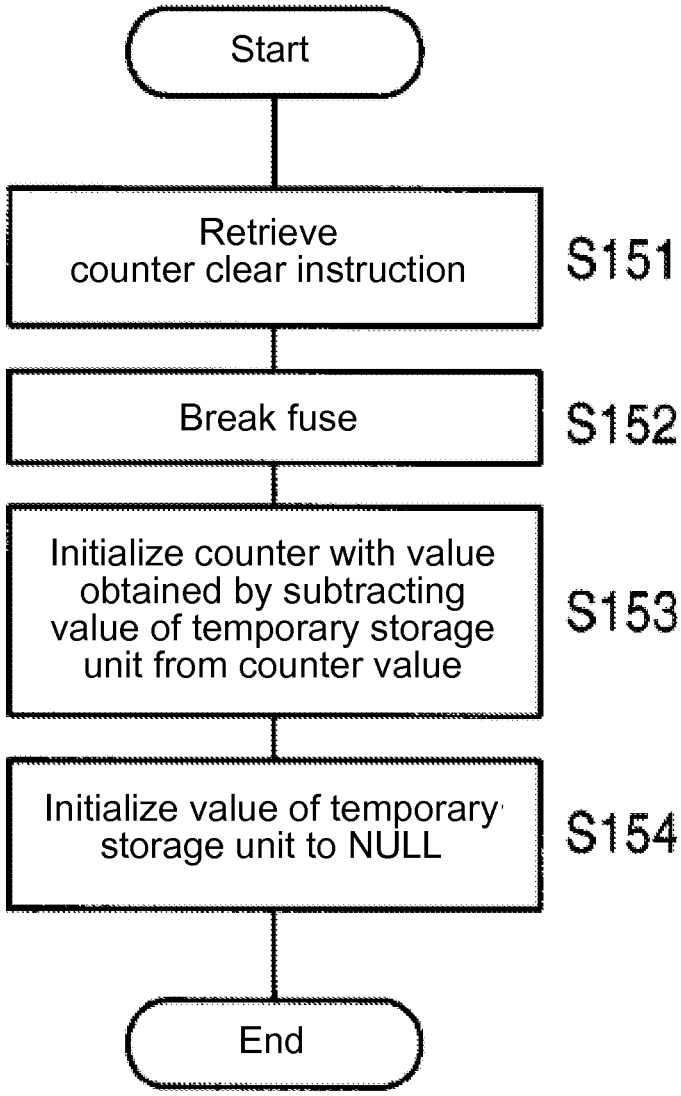
FIG. 19 is a flow chart showing the operation of the image forming apparatus in an initialization process according to the third embodiment of the present invention.

The initialization process of the control unit 20 shown in FIG. 15 (S150) will be explained with reference to FIG. 19. FIG. 19 is a flow chart showing the operation of the image forming apparatus in an initialization process according to the third embodiment of the present invention.

In step S151, the control unit 20 retrieves the counter clear instruction stored in the storage unit. In step S152, after the control unit 20 retrieves the counter clear instruction, the control unit 20 breaks one of the resetting members 11K, 11Y, 11M, and 11C (the fuses) corresponding to the specified one of the photosensitive drums 10K, 10Y, 10M, and 10C.

In step S153, after the control unit 20 breaks one of the resetting members 11K, 11Y, 11M, and 11C (the fuses), the control unit 20 initializes the one of the counters 12K, 12Y, 12M, and 12C with the value obtained by subtracting the value of the one of the temporary storage unit 13K, 13Y, 13M, and 13C from the counter value of the one of the counters 12K, 12Y, 12M, and 12C corresponding to the one of the photosensitive drums 10K, 10Y, 10M, and 10C.

In step S154, the control unit 20 initializes the value of the one of the temporary storage unit 13K, 13Y, 13M, and 13C corresponding to the specified one of the photosensitive drums 10K, 10Y, 10M, and 10C to NULL, thereby completing the process.

As described above, in the third embodiment, when the user mistakenly exchange the photosensitive drum, the counter corresponding to the photosensitive drum is returned to the counter value before the exchange if the user installs the photosensitive drum with the unexpired life before the exchange until the specific number of the sheets is printed after the photosensitive drum is exchanged. Accordingly, it is possible to accurately count the accumulation print number, so that it is possible to efficiently use the photosensitive drum.

Further, it is configured such that the fuse of the brand new photosensitive drum thus exchanged is not broken until the specific number of the sheets is printed. Accordingly, when the photosensitive drum is detached from the image forming apparatus and is attached again during the time period, the accumulation print number of the counter is initialized. Accordingly, it is possible to accurately count the accumulation print number, so that it is possible to efficiently use the photosensitive drum.

In the first embodiment to the third embodiment, the printer 500 is explained as the image forming apparatus. The present invention is not limited thereto, and may be applicable to a copier, a facsimile, and a multi function product using a photosensitive drum.

Further, in the first embodiment to the third embodiment, the resetting members 11K, 11Y, 11M, and 11C (the fuses) are explained as the member for detecting that the consumable supply is exchanged. The present invention is not limited thereto, and a sensor may be provided as a detection unit. Further, in the first embodiment to the third embodiment, the photosensitive drums 10K, 10Y, 10M, and 10C are explained as the consumable supplies. The present invention is not limited thereto, and the consumable supply may be a toner cartridge containing toner.

The disclosure of Japanese Patent Application No. 2010-237364, filed on Oct. 22, 2010, is incorporated in the application by the reference.

While the invention has been explained with reference to the specific embodiments of the invention, the explanation is illustrative and the invention is limited only by the appended claims.

What is claimed is:

1. An image forming apparatus, comprising:

a plurality of consumable supplies detachably attached to an apparatus main body;

a detection unit for detecting that a new consumable supply is attached to the apparatus main body;

a display unit for displaying first information representing which one of the consumable supplies is replaced when the detection unit detects that the new consumable supply is attached;

an input unit for receiving an input operation of a user when the display unit displays the first information; and a control unit for performing an initialization process on the new consumable supply when the input unit receives the input operation.

2. The image forming apparatus according to claim 1, further comprising a measurement unit for measuring a consumed amount of each of the consumable supplies, wherein said control unit is configured to reset the consumed amount.

3. The image forming apparatus according to claim 2, wherein said display unit is configured to display the first information when the detection unit detects that the new consumable supply is attached and the consumed amount of the one of the consumable supplies corresponding to the new consumable supply does not exceed a threshold value.

4. The image forming apparatus according to claim 3, wherein said display unit is configured to not display the first information when the detection unit detects that the new consumable supply is attached and the consumed amount of the one of the consumable supplies corresponding to the new consumable supply exceeds the threshold value.

5. The image forming apparatus according to claim 3, wherein said new consumable supply includes second information indicating that the new consumable supply is new or not, and said control unit is configured to set the second information to indicate that the new consumable supply is not new during the initialization process.

6. The image forming apparatus according to claim 5, wherein said new consumable supply includes a fuse to represent the second information, and said control unit is configured to cut the fuse to set the second information to indicate that the new consumable supply is not new.

7. An image forming apparatus, comprising:

a consumable supply detachably attached to an apparatus main body;

a measurement unit for measuring a consumed amount of the consumable supply;

a detection unit for detecting that the consumable supply is exchanged;

a temporary storage unit for storing the consumed amount of the consumable supply when the consumable supply is exchanged; and a control unit for controlling the measurement unit to continue measuring the consumed amount according to the consumed amount stored in the temporary storage unit when the detection unit detects that the consumable supply is exchanged from when the detection unit detects that the consumable supply having the consumed amount smaller than a threshold value is exchanged to when the consumed amount of the consumable supply exceeds a specific amount, wherein said consumable supply includes a usage storage unit for recording a history that the consumable supply is used, said control unit being configured to control the usage storage unit to record the history that the consumable supply is used when the consumed amount of the consumable supply exceeds the specific amount from when the detection unit detects that the consumable supply having the consumed amount smaller than the threshold value is exchanged.

8. The image forming apparatus according to claim 7, wherein said control unit is configured to control the usage storage unit to postpone storing the history that the consumable supply is used, and to postpone initializing the consumed amount from when the detection unit detects that the consumable supply having the consumed amount smaller than the threshold value is exchanged to when the consumed amount of the consumable supply exceeds the specific amount.

* * * * *